US011426042B2

(12) United States Patent
Hwang et al.

(10) Patent No.: US 11,426,042 B2
(45) Date of Patent: Aug. 30, 2022

(54) VACUUM CLEANER

(71) Applicant: LG ELECTRONICS INC., Seoul (KR)

(72) Inventors: Jung Bae Hwang, Seoul (KR); Jinrae Cho, Seoul (KR); Jung Woo Lee, Seoul (KR); Taekgi Lee, Seoul (KR); Mi-Jin Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/992,413

(22) Filed: Aug. 13, 2020

(65) Prior Publication Data

US 2021/0161340 A1 Jun. 3, 2021

(30) Foreign Application Priority Data

Dec. 3, 2019 (KR) ..... 10-2019-0159189

(51) Int. Cl.
*A47L 9/04* (2006.01)
*A47L 9/24* (2006.01)
*A47L 5/26* (2006.01)

(52) U.S. Cl.
CPC ..... *A47L 9/0477* (2013.01); *A47L 9/0411* (2013.01); *A47L 9/0461* (2013.01); *A47L 9/242* (2013.01);
(Continued)

(58) Field of Classification Search
CPC ..... A47L 9/0477; A47L 9/0466; A47L 9/242; A47L 9/248; A47L 9/0461
(Continued)

(56) References Cited

U.S. PATENT DOCUMENTS

2014/0033471 A1* 2/2014 Toole ..... A47L 9/02 15/415.1
2015/0033498 A1* 2/2015 McVey ..... A47L 9/04 15/363
(Continued)

FOREIGN PATENT DOCUMENTS

CN 106491047 3/2017
DE 102015114776 * 3/2017
(Continued)

OTHER PUBLICATIONS

DE102015114776-A1 translation from Espacenet (Year: 2021).*
(Continued)

*Primary Examiner* — Joseph J Hail
*Assistant Examiner* — Timothy Brady
(74) *Attorney, Agent, or Firm* — Fish & Richardson P.C.

(57) ABSTRACT

A vacuum cleaner includes a main body and a suction nozzle. The suction nozzle includes a connector that defines a passage configured to guide the dust in a first direction to the main body, and a housing that rotatably connects to the connector and defines an inlet configured to transfer the dust to the passage. The connector includes an insertion portion that has a cylindrical shape and is configured to insert into the inlet, a first connection portion spaced apart from the inlet in the first direction, and a coupling part disposed at an outer surface of the insertion portion. The coupling part and the first connection portion are configured to restrict movement of the housing in the first direction, and the inlet is configured to restrict deformation of at least one of the insertion portion or the coupling part.

21 Claims, 31 Drawing Sheets

(52) U.S. Cl.
CPC ..... *A47L 9/248* (2013.01); *A47L 5/26* (2013.01); *A47L 9/0466* (2013.01)

(58) Field of Classification Search
USPC ..... 15/351, 383, 411
See application file for complete search history.

(56) References Cited

U.S. PATENT DOCUMENTS

| | | | | |
|---|---|---|---|---|
| 2016/0174792 | A1* | 6/2016 | Williamson | A47L 9/068 15/383 |
| 2017/0319026 | A1* | 11/2017 | Roschi | A47L 9/009 |
| 2017/0347853 | A1* | 12/2017 | Dant | A47L 5/36 |
| 2018/0303304 | A1* | 10/2018 | Yang | H05F 1/00 |
| 2019/0313872 | A1* | 10/2019 | Ward | A47L 9/248 |
| 2020/0253438 | A1* | 8/2020 | Lee | A47L 9/0455 |
| 2020/0315414 | A1* | 10/2020 | Kovacs | A47L 9/244 |

FOREIGN PATENT DOCUMENTS

| | | | |
|---|---|---|---|
| DE | 102015114776 | A1 * | 3/2017 |
| JP | 2016195917 | | 11/2016 |
| KR | 200144974 | | 6/1999 |
| KR | 1020050054689 | | 6/2005 |
| KR | 200426993 | | 9/2006 |
| KR | 1020190021521 | | 3/2019 |
| KR | 1020190080855 | | 7/2019 |
| TW | 201806538 | | 3/2018 |

OTHER PUBLICATIONS

DE102015114776 translation from Espacenet (Year: 2021).*
PCT International Search Report in International Appln. No. PCT/KR2020/007168, dated Sep. 1, 2020, 6 pages (with English translation).
Taiwanese Office Action in Taiwan Appln. No. 109122126, dated Dec. 3, 2019, 9 pages (with English translation).

* cited by examiner

VACUUM CLEANER

CROSS-REFERENCE TO RELATED APPLICATION

This present application claims the benefit of priority to Korean Patent Application No. 10-2019-0159189, entitled "VACUUM CLEANER," filed on Dec. 3, 2019, the entire disclosure of which is incorporated herein by reference.

TECHNICAL FIELD

The present disclosure relates to a vacuum cleaner and, more particularly, to a vacuum cleaner configured to suction dust with a rotating brush from a floor.

BACKGROUND

Vacuum cleaners may have various cleaning capabilities with various types of mounting brushes.

For example, a stiff plastic brush may be used to clean carpets.

As another example, a floor brush made of soft flannel may be used to clean a smoot floor surface.

In some cases, the floor brush made of soft flannel may reduce or prevent scratches the floor which may be caused by a stiff brush. In some cases, the flannel brush may be rotated for cleaning, and fine dust on the floor may be lifted into the air and suctioned up by the vacuum cleaner.

In some cases, when an external force is applied to a first connection member of a vacuum cleaner, the connection member may be deformed and transfer the external force to a second connection member. When the second connection member receives an external force from the first connection member, the second connection member may be deformed in the opposite direction to the first connection member, that is, in the outer direction. In some cases, the vacuum cleaner, when a strong external force is applied to the first connection member, the first connection member and the second connection member may be easily decoupled.

In some cases, an end of the second connection member may be rotatably coupled to the first connection member by forceful insertion. In some cases, excessive force may be applied to couple and decouple the first connection member and the second connection member. In some instances, when the first connection member and the second connection member are decoupled from each other for purposes such as repairing of the vacuum cleaner, the first connection member and the second connection member may be easily become worn or broken at areas that are coupled by forceful insertion.

In some cases, when the first connection member rotates, friction may be focused on a contact surface between the first connection member and the second connection member. The focused friction may accelerate abrasion of components.

SUMMARY

The present disclosure describes a vacuum cleaner that includes a housing and a connector that may maintain coupling even when a strong external force is applied to a connected portion between the housing and the connector.

The present disclosure also describes a vacuum cleaner that include a housing and a connector that may be easily decoupled for purposes such as repairing of the vacuum cleaner.

The present disclosure further describes a vacuum cleaner that may avoid friction concentration on the connected part between the housing and the connector.

According to one aspect of the subject matter described in this application, a vacuum cleaner includes a main body configured to generate a differential air pressure with respect to an outside of the vacuum cleaner, and a suction nozzle configured to suction dust from the outside based on the differential air pressure. The suction nozzle includes a connector that defines a passage configured to guide the dust in a first direction to the main body, and a housing that is configured to rotatably connect to the connector and defines an inlet, where the inlet has a cylindrical shape and is configured to transfer the dust to the passage. The connector includes an insertion portion that has a cylindrical shape and is configured to insert into the inlet, a first connection portion spaced apart from the inlet in the first direction, and a coupling part disposed at an outer surface of the insertion portion. The coupling part and the first connection portion are configured to restrict movement of the housing in the first direction, and the inlet is configured to restrict deformation of at least one of the insertion portion or the coupling part.

Implementations according to this aspect may include one or more of the following features. For example, one of the insertion portion or the coupling part may define a catch hole, and the other of the insertion portion or the coupling part may include a catch portion configured to insert into the catch hole. In some examples, the coupling part may include a pipe portion that defines one of the catch portion or the catch hole, and a protrusion portion that protrudes from an outer surface of the pipe portion and extends along a circumferential direction of the pipe portion. An inner surface of the inlet may be configured to surround the outer surface of the pipe portion.

In some implementations, the protrusion portion may define a first boundary surface, and the first connection portion may define a second boundary surface configured to face the first boundary surface and be spaced apart from the first boundary surface in the first direction. The housing may include an interposition portion configured to be disposed between the first boundary surface and the second boundary surface. In some implementations, the protrusion portion may define a third boundary surface, and the interposition portion may define a fourth boundary surface configured to face the third boundary surface in a radial direction of the pipe portion.

In some implementations, the coupling part may include a spacing protrusion portion that protrudes from the outer surface of the pipe portion and extends along the circumferential direction of the pipe portion.

In some implementations, the vacuum cleaner may further include a rotating brush disposed in the housing, and the housing may include a main housing that defines the inlet and is configured to accommodate the rotating brush, and a mounting housing coupled to the main housing. The interposition portion may be disposed at the mounting housing. In some examples, the mounting housing may include a mounting portion configured to surround the protrusion portion of the coupling part, where the protrusion portion defines a fifth boundary surface. The mounting portion may define a sixth boundary surface configured to face the fifth boundary surface in the radial direction of the pipe portion.

In some implementations, the connector may include a second connection portion rotatably connected to the first connection portion, and an elastic pipe that defines at least a portion of the passage and is disposed between the inlet and the second connection portion. In some examples, the elastic pipe may include an elastic tube that extends between the inlet and the second connection portion, and a coil spring attached to the elastic tube and configured to be compressed and extended in a range between the inlet and the second connection portion.

According to another aspect, a vacuum cleaner includes a main body configured to generate a differential air pressure with respect to an outside of the vacuum cleaner, and a suction nozzle configured to suction dust from the outside based on the differential air pressure. The suction nozzle includes a connector that defines a passage configured to guide the dust in a first direction to the main body, and a housing that defines an inlet having a cylindrical shape and being configured to transfer the dust to the passage. The connector includes a pipe portion that has a cylindrical shape and is configured to insert into the inlet, a protrusion portion that protrudes from an outer surface of the pipe portion and defines a first boundary surface, an insertion portion that has an outer surface configured to face the pipe portion, and a first connection portion spaced apart from the inlet in the first direction. The first connection portion defines a second boundary surface configured to face the first boundary surface in the first direction. The housing includes an interposition portion configured to be disposed between the first boundary surface and the second boundary surface, and the inlet is configured to restrict deformation of at least one of the insertion portion or the pipe portion.

Implementations according to this aspect may include one or more of the following features. For example, the vacuum cleaner may further include a rotating brush disposed in the housing, and the housing may include a main housing that defines the inlet and is configured to accommodate the rotating brush and a mounting housing coupled to the main housing.

In some implementations, the mounting housing may include a cover portion that extends along an axial direction of the rotating brush and covers an upper surface of the main housing, and a mounting portion that surrounds the protrusion portion of the connector. In some examples, the mounting portion may define an aperture that receives the pipe portion and the insertion portion, and the first connection portion may be disposed outside of the mounting portion.

In some examples, the pipe portion and the protrusion portion may be disposed in the aperture and configured to couple to the insertion portion. In some examples, the pipe portion may include a catch portion that protrudes from the outer surface of the pipe portion in a radial direction of the pipe portion, and the insertion portion may define a catch hole configured to couple to the catch portion. In some examples, the insertion portion may have a cylindrical shape and include a catch portion that protrudes from the outer surface of the insertion portion in a radial direction of the insertion portion. The pipe portion may define a catch hole configured to couple to the catch portion.

In some implementations, the connector may include a second connection portion disposed rearward relative to the first connection portion and rotatably connected to the first connection portion, and an elastic pipe that defines at least a portion of the passage and that has a first portion connected to the inlet and a second portion connected to the second connection portion.

In some examples, the housing may be configured to cover the pipe portion, the insertion portion, and the first portion of the elastic pipe. In some examples, the first connection portion and the second connection portion may define an opening that exposes at least a portion of the elastic pipe.

BRIEF DESCRIPTION OF THE DRAWINGS

The use of the same reference numerals or symbols in different drawings indicates similar or identical items.

DETAILED DESCRIPTION

Figure 1:
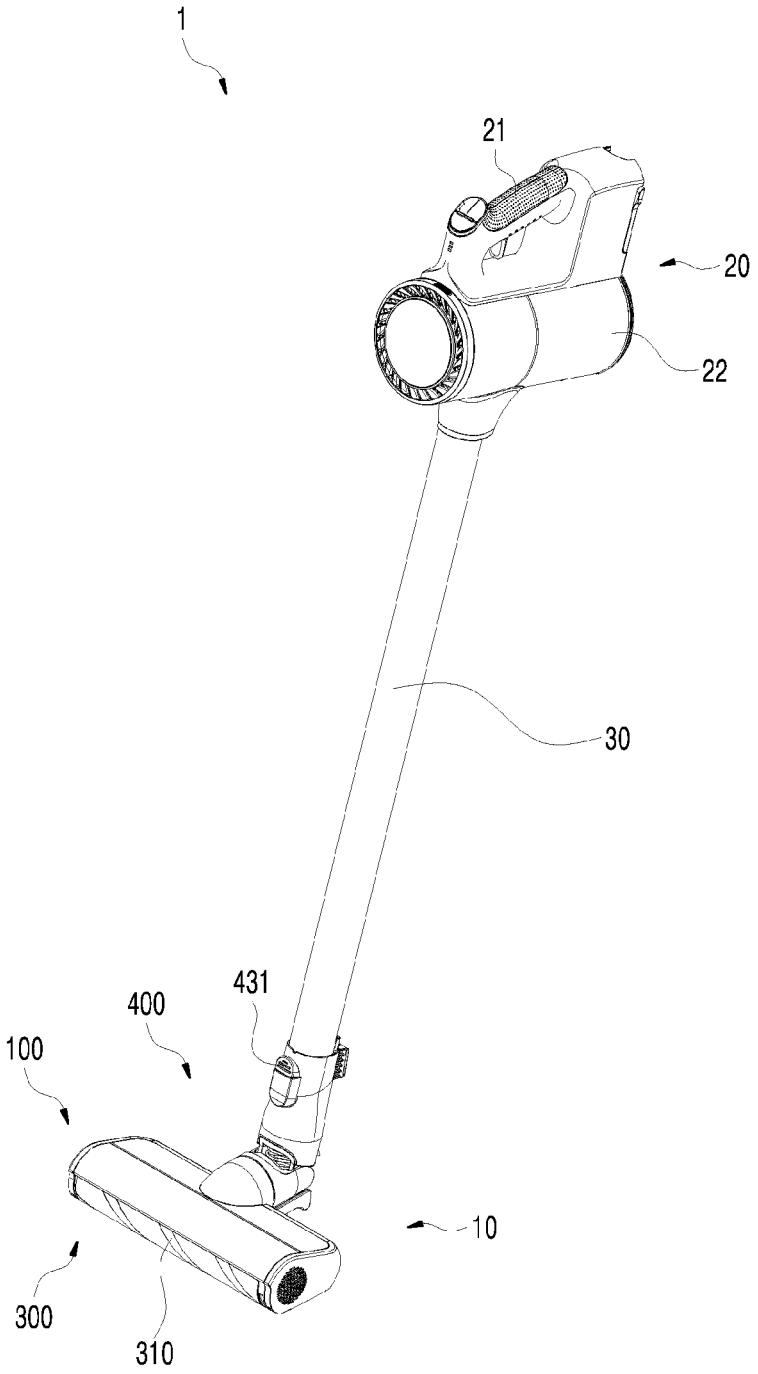
FIG. 1 is a perspective view of an example of a vacuum cleaner.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

Hereinafter, one or more example implementations of the present disclosure will be described in detail referring to the attached drawings. In the following description, known functions or features will not be described in order to clarify the gist of the present disclosure.

FIG. 1 is a perspective view of an example of a vacuum cleaner 1.

As illustrated in FIG. 1, the vacuum cleaner 1 may include a main body 20 and a suction nozzle 10.

The suction nozzle 10 may be connected to the main body 20 through an extension pipe 30. The suction nozzle 10 may be directly connected to the main body 20. A user may grip a handle 21 formed in the main body 20 and move the suction nozzle 10 back and forth on a floor.

The main body 20 may generate a difference in air pressure. Inside the main body 20, an air blower may be provided. When the air blower generates a difference in air pressure, dust and debris on the floor may be moved into the main body 20 through an inlet 111 of the suction nozzle 10 and the extension pipe 30.

Inside the main body 20, a centrifugal dust collector may be provided. The dust and debris may be received in a dust box 22.

Figure 2:
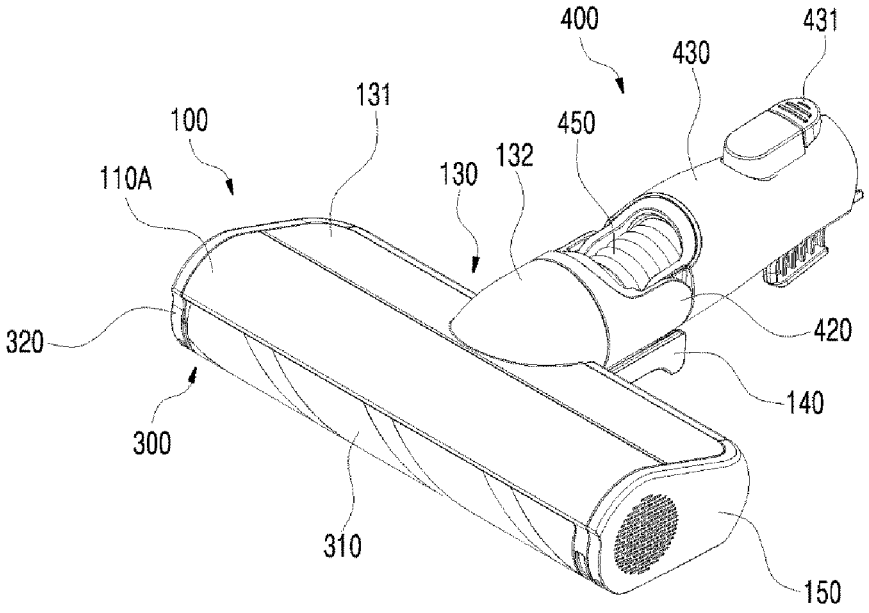
FIG. 2 is a perspective view of an example of a suction nozzle of the vacuum cleaner of FIG. 1 seen from above.
Figure 3:
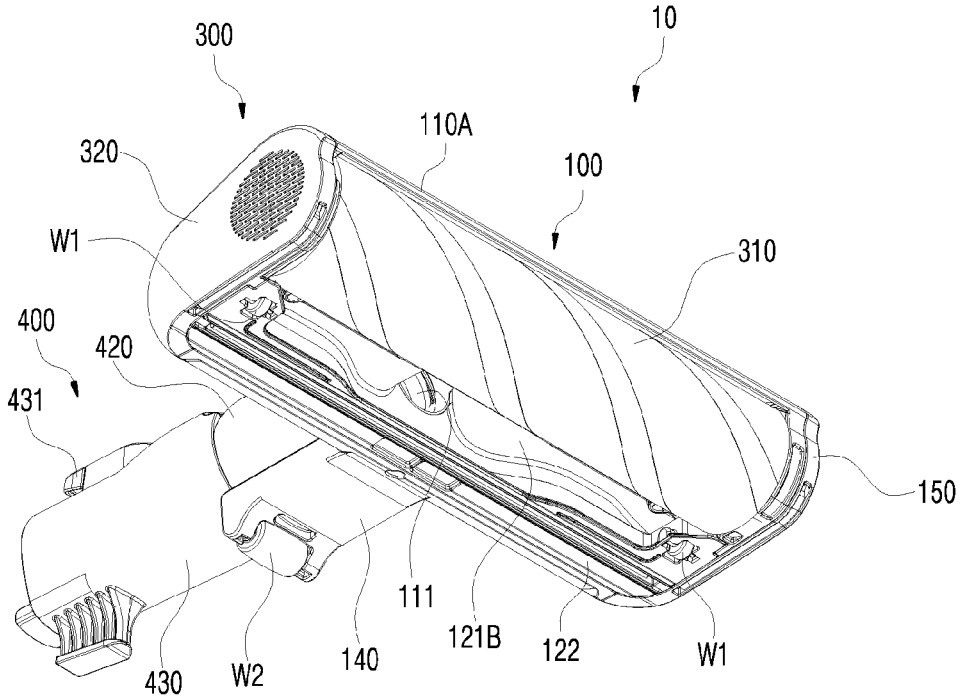
FIG. 3 is a perspective view of the suction nozzle of the vacuum cleaner of FIG. 1 seen from below.
Figure 4:
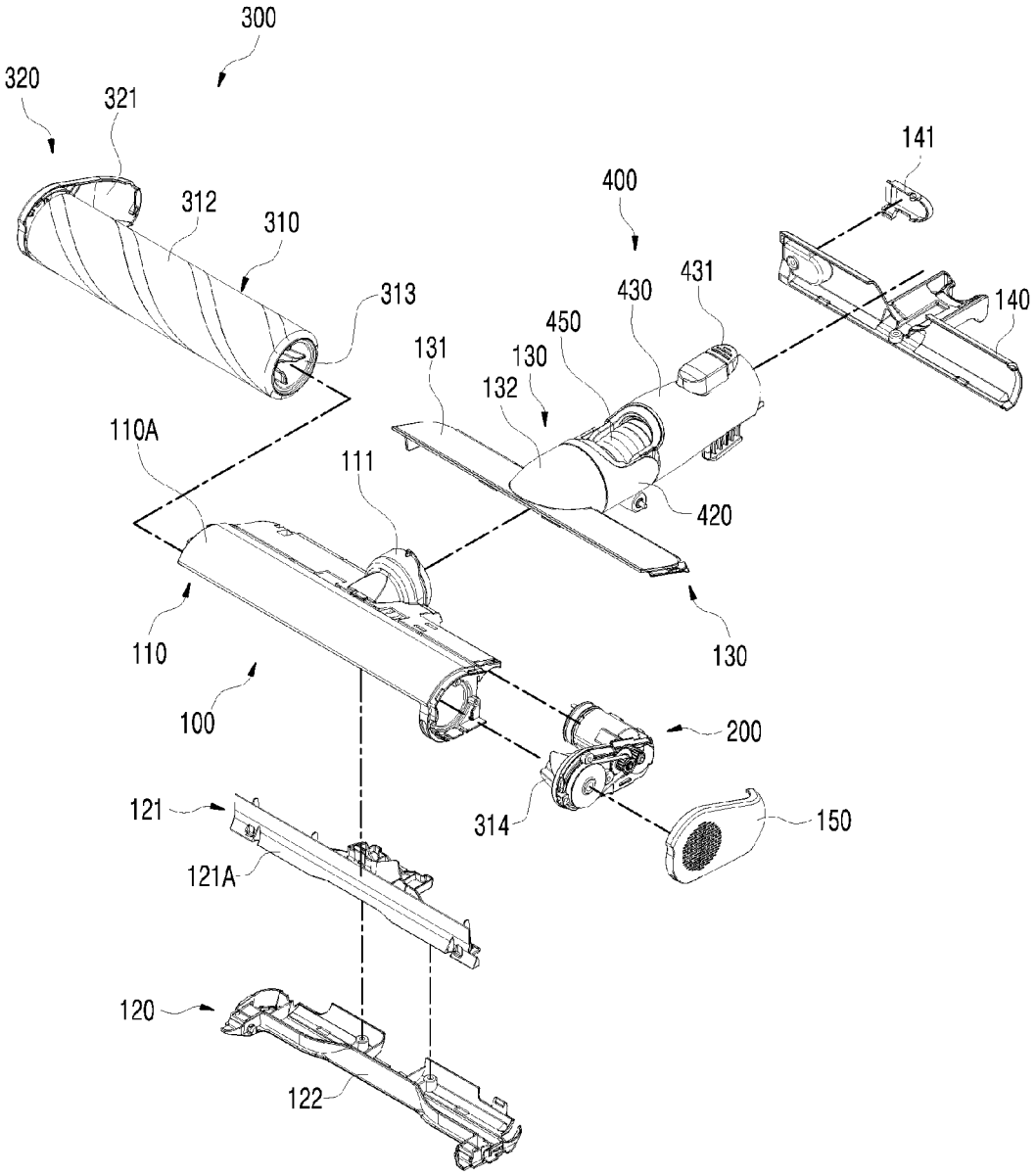
FIG. 4 is an exploded perspective view of the suction nozzle of FIG. 2.

FIG. 2 is a perspective view of an example of a suction nozzle 10 of the vacuum cleaner 1 of FIG. 1 seen from above. FIG. 3 is a perspective view of the suction nozzle 10 of the vacuum cleaner 1 of FIG. 1 seen from below. FIG. 4 is an exploded perspective view of the suction nozzle 10 of FIG. 2.

The suction nozzle 10 may suction dust on the floor by using a difference in air pressure. The suction nozzle 10 may include a housing 100, a driver 200, a brush module 300, and a connector 400.

Hereinafter, for easy understanding of the present disclosure, a side of the suction nozzle 10 where a rotating brush 310 is positioned will be referred to as the front of the suction nozzle 10, and a side of the suction nozzle 10 where the connector 400 is positioned will be referred to as the rear or back of the suction nozzle 10.

The suction nozzle 10 may be assembled in the following order. First of all, the connector 400 may be assembled. Secondly, a mounting housing 130 may be assembled with the connector 400.

The mounting housing 130 may be rotatably mounted in the connector 400. Then, the driver 200 may be coupled to one side of a main housing 110. For example, the driver 200 may include a motor.

Thereafter, the mounting housing 130 may be coupled to an upper portion of the main housing 110. Next, a lower housing 120 may be coupled to a lower portion of the main housing 110. Then, a support housing 140 may be coupled to a lower portion of the main housing 110.

Thereafter, a pressing button 141 may be mounted in the support housing 140. Next, a side surface cover 150 may be coupled to one side of the main housing 110.

In some examples, a first shaft member 232D may be inserted into a second shaft member 313 of a rotating brush 310, and a detachable cover 320 may be detachably coupled to the other side of the main housing 110. Then, the assembly of the suction nozzle 10 may be completed.

Figure 5:
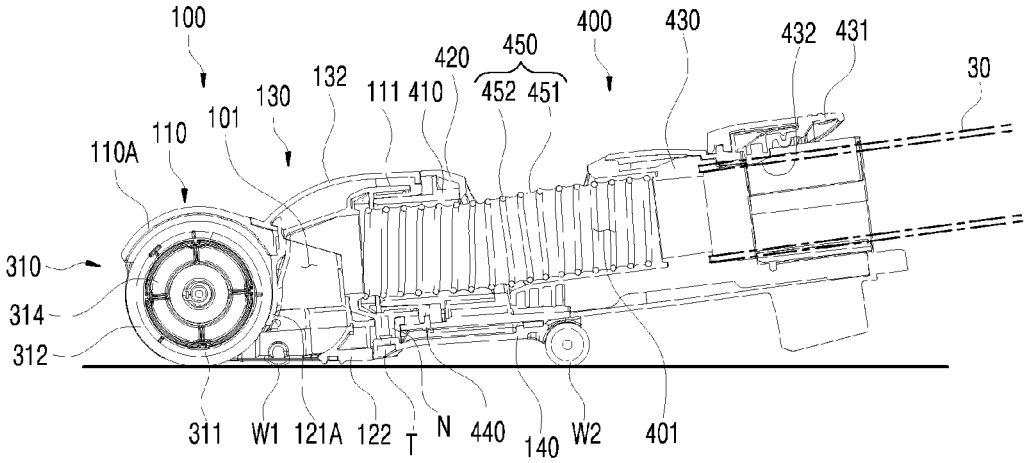
FIG. 5 is a cross-sectional view of the suction nozzle of FIG. 2.

FIG. 5 is a cross-sectional view of the suction nozzle 10 of FIG. 2.

As illustrated in FIGS. 4 and 5, the housing 100 may guide dust and debris on the floor to a passage 401 of the connector 400.

The housing 100 may include a main housing 110, a lower housing 120, a mounting housing 130, and a support housing 140.

The main housing 110 may form an inlet 111 through which dust moves to the main body 20. The inlet 111 may be formed behind the main housing 110. The inlet 111 may be formed in a cylindrical shape. A rotating brush 310 may be mounted in front of the main housing 110.

A front of the main housing 110 (hereinafter referred to as a "front portion 110A") may be formed to cover an upper portion of the rotating brush 310. The front portion 110A may form a wall that extends in a circumferential direction of a rotational axis of the rotating brush 310. The front portion 110A may be spaced apart from the upper portion of the rotating brush 310 by a certain distance.

The rotating brush 310 may be rotated by the driver 200. The rotating brush 310 may push dust and debris on the floor to behind the rotating brush 310. The dust and debris pushed to behind the rotating brush 310 may easily enter the inlet 111. The main housing 110, positioned between the rotating brush 310 and the inlet 111, may cover the surface of the floor.

Between the rotating brush 310 and the inlet 111, the housing 100 may form a space (hereinafter referred to as a "suction space 101") between the housing 100 and the floor. Excluding a gap formed between the housing 100 and the floor, the suction space 101 may be isolated from outside. The dust and debris in the suction space 101 may enter the passage 401 through the inlet 111.

As illustrated in FIGS. 4 and 5, the lower housing 120, with the main housing 110, may form the suction space 101.

The lower housing 120 may include a first lower housing 121 and a second lower housing 122.

The first lower housing 121 and the second lower housing 122, positioned between the rotating brush 310 and the inlet 111, may form a wall which guides the dust and debris in the suction space 101 towards the inlet 111.

The lower housing 120, with the support housing 140, may be coupled to a lower portion of the main housing 110 by means of a bolt. In the main housing 110, a fastening portion (N) to which a bolt is screw-coupled may be formed. An insertion portion (T) into which a bolt is inserted may be formed in the first lower housing 121, the second lower housing 122, and the support housing 140.

The first lower housing 121 may include a first wall surface 121A and a second wall surface 121B.

An upper portion of the first wall surface 121A may come into close contact with a rear end of the front portion 110A. A front surface of the first wall surface 121A may come into contact with the brush member 312. When the brush member 312 rotates, dust and debris adhering to the brush member 312 may bump against a lower portion of the first wall surface 121A to thereby come off the brush member 312.

The second wall surface 121B and the second lower housing 122, positioned between left and right sides of the inlet 111 and the floor, may form a wall which guides dust and debris in the suction space 101 towards the inlet 111. A pair of first wheels (W1) may be mounted in the second lower housing 122.

Figure 6:
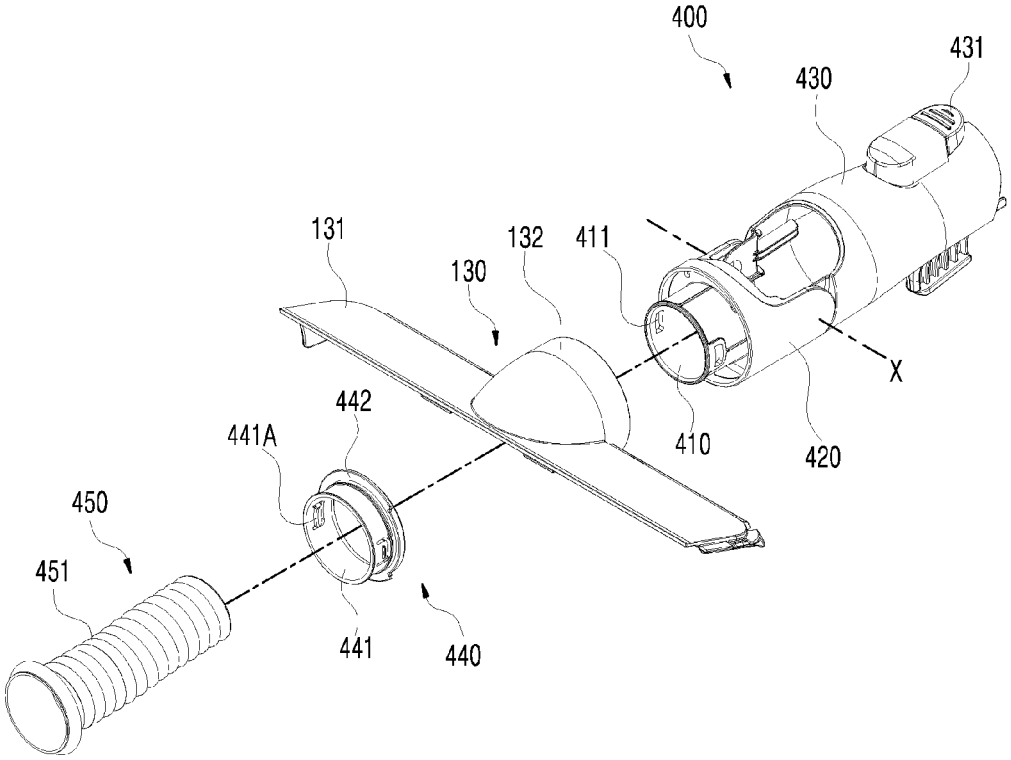
FIG. 6 is an exploded perspective view of examples of a mounting housing and a connector of the suction nozzle of FIG. 4 seen from above.
Figure 7:
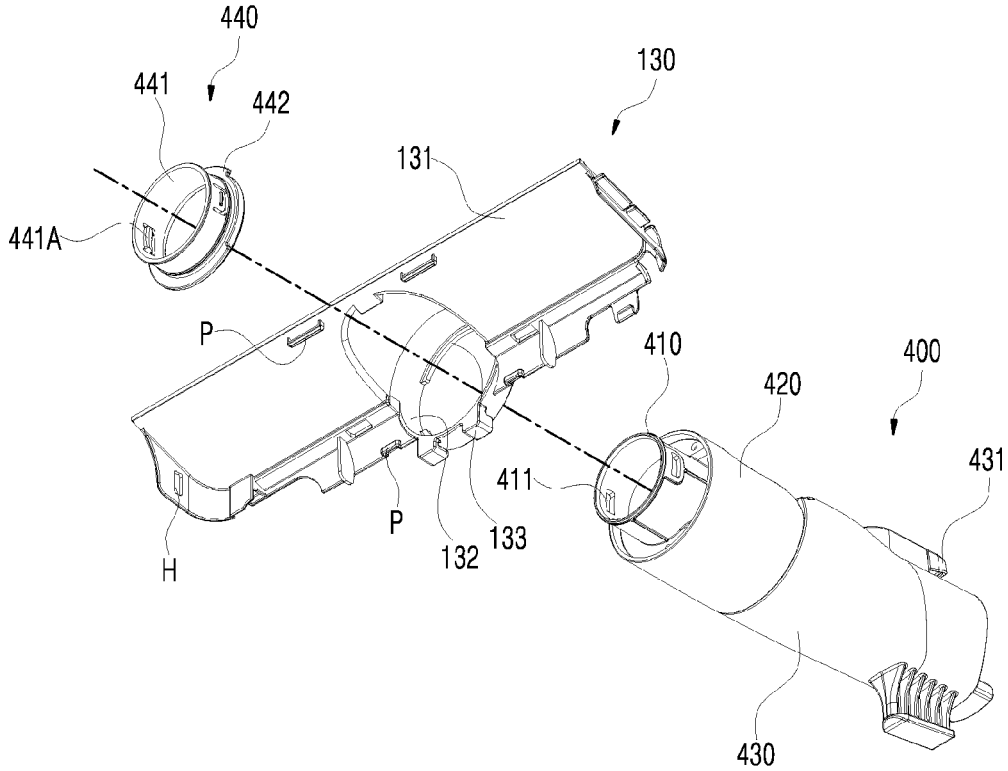
FIG. 7 is an exploded perspective view of the mounting housing and the connector of the suction nozzle of FIG. 4 seen from below.

FIG. 6 is an exploded perspective view of an example of a mounting housing 130 and the connector 400 of the suction nozzle 10 of FIG. 4 seen from above. FIG. 7 is an exploded perspective view of the mounting housing 130 and the connector 400 of the suction nozzle 10 of FIG. 4 seen from below.

As illustrated in FIGS. 6 and 7, the mounting housing 130 may include a cover portion 131, a mounting portion 132, and an interposition portion 133.

The cover portion 131 may be a portion that is mounted in an upper portion of the main housing 110. In any one of the cover portion 131 or the main housing 110, a protrusion (P) may be formed. In the other one of the cover portion 131 or the main housing 110, a hole (H) may be formed. As the protrusion (P) is inserted into the hole (H), the cover portion 131 may be mounted in the upper portion of the main housing 110.

The mounting portion 132 may be a portion that surrounds the inlet 111 and a coupling part 440. The mounting portion 132 may be formed in a ring shape.

The interposition portion 133 may protrude from an inner surface of the mounting portion 132. The interposition portion 133 may be a portion that is rotatably mounted in the connector 400. The interposition portion 133 may protrude from the inner surface of the mounting portion 132 along a circumferential direction of the mounting portion 132.

As illustrated in FIGS. 4 and 5, the support housing 140 may support lower portions of the suction nozzle 10 and the connector 400.

In the support housing 140, a second wheel (W2) may be mounted. The second wheel (W2) may, together with the pair of first wheels (W1), rotate and roll on the floor.

The pair of first wheels (W1) and the second wheel (W2) may provide a rolling motion to the suction nozzle 10 and the connector 400. A pressing button 141 may be mounted in the support housing 140.

The connector 400 may enable relative rotation of the main body 20 and the suction nozzle 10. In addition, the connector 400 may form therein the passage 401 through which dust moves to the main body 20.

As illustrated in FIGS. 6 and 7, the connector 400 may include an insertion portion 410, a first connection portion 420, a second connection portion 430, a coupling part 440, and an elastic pipe 450.

Each of the first connection portion 420 and the second connection portion 430 may be formed in a pipe shape. The first connection portion 420 and the second connection portion 430 may be rotatably coupled to each other.

In some implementations, in any one of the first connection portion 420 or the second connection portion 430, a pair of protrusions may be formed. In addition, in the other one of the first connection portion 420 or the second connection portion 430, a pair of grooves may be formed.

The pair of protrusions may be formed on an outer surface of the second connection portion 430 at both sides thereof. The pair of grooves may be formed on an inner surface of the first connection portion 420 at both sides thereof. The protrusions may be inserted into the grooves. The second connection portion 430 may be rotated about the protrusions inserted into the grooves. Reference sign "X" in FIG. 6 indicates an extension line of the rotational axis formed by the protrusions.

As illustrated in FIG. 5, in an upper portion of the second connection portion 430, a release button 431 may be formed. The release button 431 may be connected to an engaging portion 432. In an upper portion of the second connection portion 430, a hole may be formed. The engaging portion 432 may protrude into the second connection portion 430 through the hole.

In the extension pipe 30, a hole into which the engaging portion 432 is inserted may be formed. Movement of the extension pipe 30 may be blocked by the engaging portion 432.

When a user presses the release button 431, the engaging portion 432 may move upward and be released from the hole of the extension pipe 30. Accordingly, the second connection portion 430 and the extension pipe 30 may be separated from each other. When an external force applied to the release button 431 is removed, the release button 431 may rise again by means of its elasticity. When the external force applied to the release button 431 is removed, the engaging portion 432 may move downward again.

As illustrated in FIG. 5, the elastic pipe 450 may form the passage 401 between the inlet 111 and the second connection portion 430. The elastic pipe 450 may include an elastic tube 451 and a coil spring 452.

The elastic tube 451 may form therein the passage 401. The elastic tube 451 may be formed in a cylindrical shape. The elastic tube 451 may be made of a soft resin. Accordingly, the elastic tube 451 may be elastically deformed when the first connection portion 420 and the second connection portion 430 are relatively rotated, and when the mounting portion 132 and the first connection portion 420 are relatively rotated.

The coil spring 452 may be attached to an inner surface or an outer surface of the elastic tube 451. The coil spring 452 may maintain the cylindrical shape of the elastic tube 451.

In a compressed state, the coil spring 452 may be mounted between the inlet 111 and the second connection portion 430. In each of the inlet 111 and the second connection portion 430, a raised portion may be formed, and both end portions of the coil spring 452 may be caught by the raised portions of the inlet 111 and the second connection portion 430.

A distance between the raised portions of the inlet 111 and the second connection portion 430 may change when the first connection portion 420 and the second connection portion 430 are relatively rotated, and when the mounting portion 132 and the first connection portion 420 are relatively rotated.

The elastic tube 451 may be maintained to be in close contact with the raised portions of the inlet 111 and the second connection portion 430 by means of the elasticity of the coil spring 452 while the first connection portion 420 and the second connection portion 430 are relatively rotated, and the mounting portion 132 and the first connection portion 420 are relatively rotated.

Figure 8:
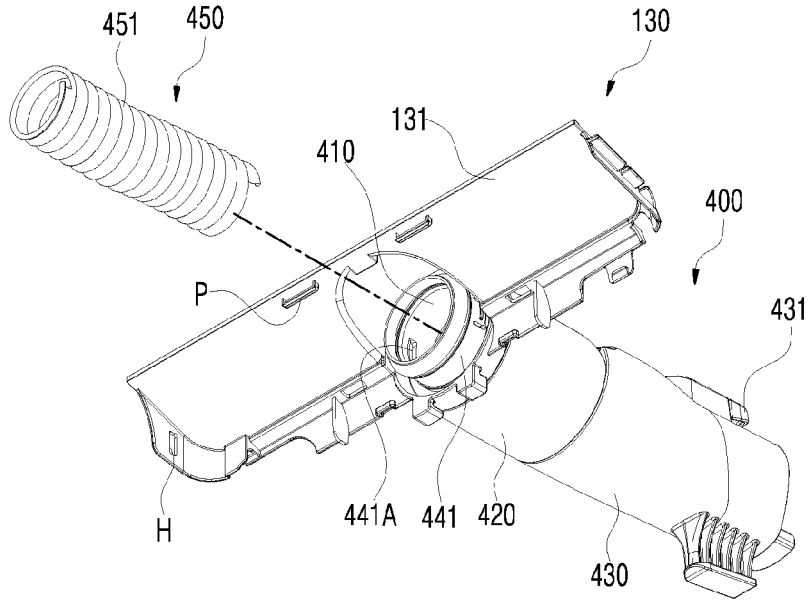
FIG. 8 is a perspective view of an example of an assembled state of the mounting housing and the connector of the suction nozzle of FIG. 4.
Figure 9:
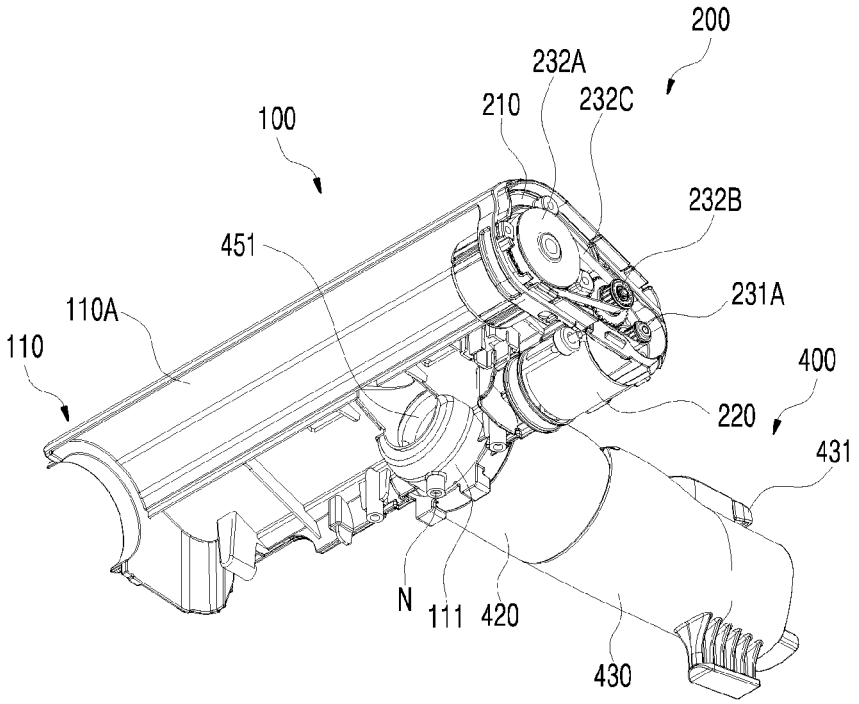
FIG. 9 is a perspective view of an example of an assembled state of the main housing, the mounting housing, and the connector of the suction nozzle of FIG. 4.

FIG. 8 is a perspective view of an example of an assembled state of the mounting housing 130 and the connector 400 of the suction nozzle 10 of FIG. 4. FIG. 9 is a perspective view of an example of an assembled state of the main housing 110, the mounting housing 130, and the connector 400 of the suction nozzle 10 of FIG. 4.

Figure 10:
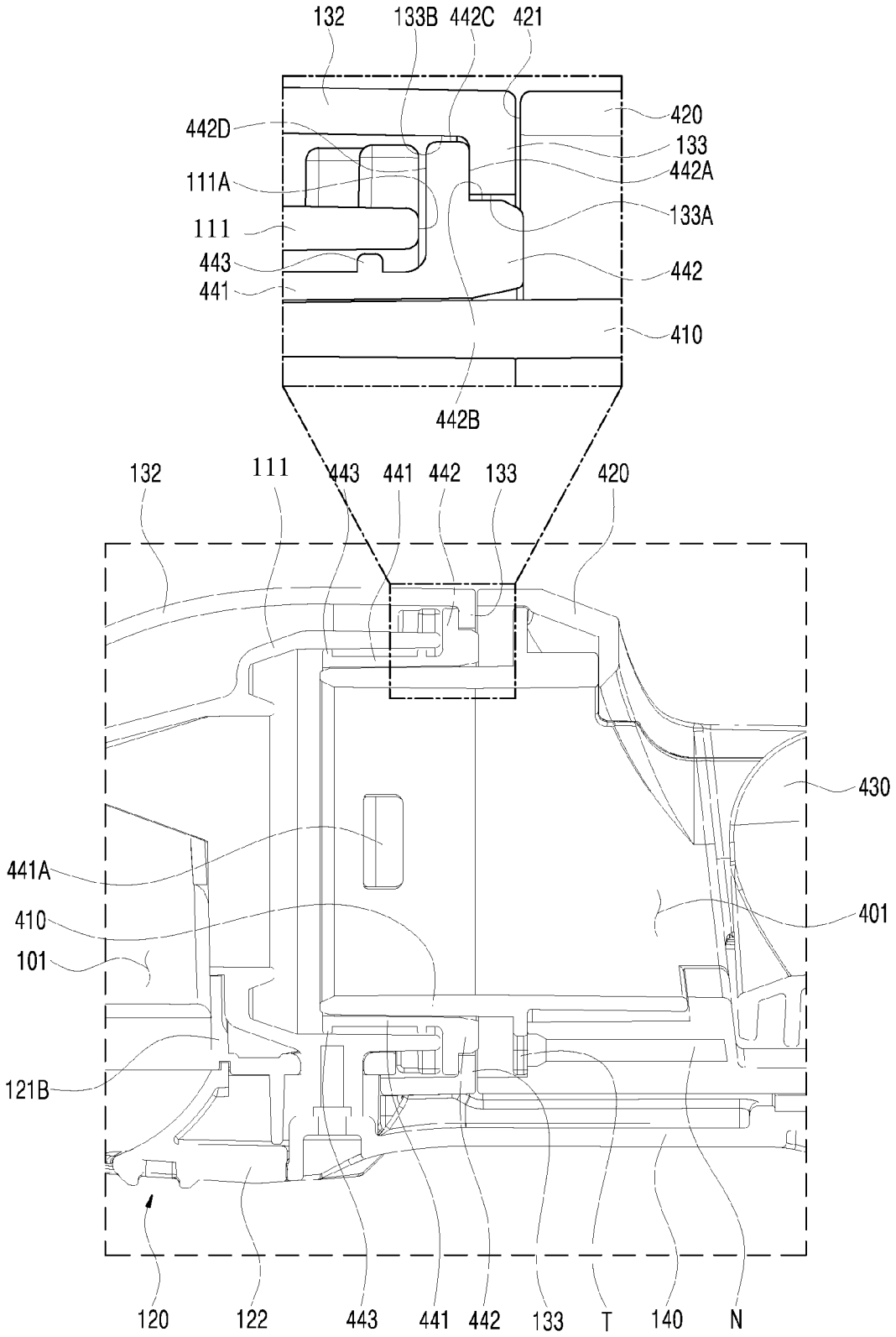
FIG. 10 is a partial cross-sectional view of an example of an assembled state of the main housing, the mounting housing, and the connector of the suction nozzle of FIG. 9.

FIG. 10 is a partial cross-sectional view of an example of an assembled state of the main housing 110, the mounting housing 130, and the connector 400 of the suction nozzle 10 of FIG. 9.

The insertion portion 410 may be formed in a pipe shape having a diameter smaller than a diameter of the first connection portion 420. The insertion portion 410 may be coupled inside the first connection portion 420 by means of a bolt. In the first connection portion 420, a fastening portion (N) to which a bolt is screw-coupled may be formed. In the insertion portion 410, an insertion portion (T) into which a bolt is inserted may be formed.

The insertion portion 410 may protrude forward from inside the first connection portion 420. A front surface of the first connection portion 420 may be formed in a ring shape surrounding the insertion portion 410.

The coupling part 440 may connect the mounting housing 130 and the connector 400 to each other in such a manner that the mounting housing 130 and the connector 400 rotate about the insertion portion 410. The coupling part 440 may restrain forward and backward movement of the mounting portion 132 and the interposition portion 133 from the first connection portion 420. In other words, the coupling part 440 may restrain forward and backward movement of the insertion portion 410 and the first connection portion 420 from the interposition portion 133.

After the insertion portion 410 is inserted into the mounting portion 132, the coupling part 440 may be mounted in an outer surface of the insertion portion 410. Thereafter, the elastic pipe 450 may be inserted into the insertion portion 410. Then, the cover portion 131 may be mounted in an upper portion of the main housing 110.

When the cover portion 131 is mounted in the upper portion of the main housing 110, the insertion portion 410 may be inserted into the inlet 111. The first connection portion 420 may be spaced apart from the inlet 111 in the direction of the passage 401. The "direction of the passage 401" should be understood as the "direction of the central axis of the insertion portion 410."

As illustrated in FIGS. 7 and 10, the coupling part 440 may include a pipe portion 441, a protrusion portion 442, and a spacing protrusion portion 443.

The pipe portion 441 may be formed in a cylindrical shape. When the coupling part 440 is mounted in the outer surface of the insertion portion 410, an inner surface of the pipe portion 441 may surround the outer surface of the insertion portion 410. Thereafter, when the cover portion 131 is mounted in the upper portion of the main housing 110, the inner surface of the inlet 111 may surround the outer surface of the pipe portion 441.

The spacing protrusion portion 443 may protrude from the outer surface of the pipe portion 441 in a circumferential direction. The pipe portion 441 may be spaced apart from the inner surface of the inlet 111 by means of the spacing protrusion portion 443. The spacing protrusion portion 443 may also be spaced apart from the inner surface of the inlet 111.

When an external force is applied to the connector 400, the spacing protrusion portion 443 may come into contact with the inner surface of the inlet 111. A contact surface between the spacing protrusion portion 443 and the inlet 111 may be relatively small compared to the outer surface of the pipe portion 441. Accordingly, even when the spacing protrusion portion 443 comes into contact with the inner surface of the inlet 111, relative rotation of the mounting housing 130 and the first connection portion 420 may be possible.

In a vacuum cleaner in related art, when the second connection member receives an external force from the first connection member, the second connection member may be deformed in the opposite direction to the first connection member, that is, in the outer direction. For this reason, the connection members in the related art, which are rotatably coupled, may easily become decoupled by an external force applied to the first connection member.

In the vacuum cleaner 1, when the coupling part 440 is mounted in the outer surface of the insertion portion 410, the inner surface of the pipe portion 441 may surround the outer surface of the insertion portion 410. Thereafter, when the cover portion 131 is mounted in the upper portion of the main housing 110, the inner surface of the inlet 111 may surround the outer surface of the pipe portion 441.

Accordingly, when the pipe portion 441, which has received the external force from the insertion portion 410, is deformed in the opposite direction to the insertion portion 410, that is, in the outer direction, the inner surface of the inlet 111 may serve as a boundary surface for restricting deformation of the pipe portion 441.

That is, even when the insertion portion 410 is deformed by the external force applied to the connector 400, and thus the external force is transferred to the pipe portion 441, the inlet 111 may have a rigidity by which deformation of the pipe portion 441 may be prevented.

Accordingly, the inlet 111 may restrict relative deformation of the insertion portion 410 and the coupling part 440. As a result, in the vacuum cleaner 1, even when a strong external force acts on the connector 400, the mounting portion 132 and the first connection portion 420 may not become decoupled from each other.

As illustrated in FIGS. 7 and 10, in any one of the insertion portion 410 or the pipe portion 441, a catch hole 411 may be formed. In the other one of the insertion portion 410 or the pipe portion 441, a catch portion 441A may be formed. For example, the catch portion 441A may be formed in the pipe portion 441, and the catch hole 411 may be formed in the insertion portion 410.

The catch portion 441A may protrude inward from an inner surface of the pipe portion 441. The protruding height of the catch portion 441A inside the pipe portion 441 may become smaller towards the backward direction.

When the insertion portion 410 is inserted into the coupling part 440, the catch portion 441A may be bent outwards by the outer surface of the insertion portion 410. When the catch portion 441A is inserted into the catch hole 411, the coupling part 440 may be mounted in the outer surface of the insertion portion 410.

The catch portion 441A may form a surface perpendicular to the direction of the passage 401. Accordingly, even when the coupling part 440 is pulled in the forward direction, a state in which the catch portion 441A is caught in the catch hole 411 may be maintained.

In the vacuum cleaner of related art, the connection members, which are rotatably connected to each other, may be coupled to each other by forceful insertion. Accordingly, when the connection members of related art are decoupled from each other for the purpose of repairing and the like, the connection members may easily become worn or broken at areas that are coupled by the forceful insertion.

In some implementations of the vacuum cleaner 1, when the catch portion 441A is pushed outwards from inside the insertion portion 410, the catch portion 441A that is caught in the catch hole 411 may be easily released from the catch hole 411.

When the coupling part 440 is pulled forwards while the catch portion 441A is being pushed outwards from inside the insertion portion 410, the insertion portion 410 and the coupling part 440 may be easily decoupled from each other. Accordingly, the present disclosure has an advantage in that the mounting housing 130 and the first connection portion 420 may be easily decoupled without any abrasion or damage.

As illustrated in FIGS. 7 and 10, the protrusion portion 442 may protrude from the outer surface of the pipe portion 441 in the circumferential direction. The protrusion portion 442 may form a first boundary surface 442A.

The first connection portion 420 may form a second boundary surface 421. The second boundary surface 421 may be spaced apart from the first boundary surface 442A in the direction of the passage 401.

When the coupling part 440 is mounted in the outer surface of the insertion portion 410, the interposition portion 133 may be interposed between the first boundary surface 442A and the second boundary surface 421. The first boundary surface 442A and the second boundary surface 421 may block movement of the interposition portion 133 in the direction of the passage 401.

The first boundary surface 442A and the second boundary surface 421 may form a ring shape around a central axis of the insertion portion 410. The first boundary surface 442A and the second boundary surface 421 may face each other in a direction of the central axis of the insertion portion 410. Accordingly, the mounting housing 130 may be mounted in the connector 400 so as to rotate about the central axis of the insertion portion 410.

The protrusion portion 442 may form a third boundary surface 442B. The third boundary surface 442B may be formed on an outer surface of the protrusion portion 442 in a circumferential direction. The third boundary surface 442B may have a constant radius along the circumferential direction of the central axis of the insertion portion 410. The first boundary surface 442A and the third boundary surface 442B may form an angle of about 90 degrees.

The interposition portion 133 may form a fourth boundary surface 133A. The mounting portion 132 may form a circular ring shape. The interposition portion 133 may form the fourth boundary surface 133A along a circumferential direction of a central axis of the mounting portion 132. The second boundary surface 421 and the fourth boundary surface 133A may form an angle of about 90 degrees.

The third boundary surface 442B and the fourth boundary surface 133A may face each other in a radial direction of the pipe portion 441. The third boundary surface 442B and the fourth boundary surface 133A may come into close contact with each other when the insertion portion 410 moves in a radial direction. Accordingly, the third boundary surface 442B and the fourth boundary surface 133A may block radial directional movement of the insertion portion 410 with respect to the mounting portion 132.

The protrusion portion 442 may form a fifth boundary surface 442C. The fifth boundary surface 442C may be formed on an outer surface of the protrusion portion 442 in the circumferential direction.

The third boundary surface 442B may have a constant radius along the circumferential direction of the central axis of the insertion portion 410. The third boundary surface 442B and the fifth boundary surface 442C may form a stepped portion. The first boundary surface 442A and the fifth boundary surface 442C may form an angle of about 90 degrees.

On an inner surface of the mounting portion 132, a sixth boundary surface 133B may be formed. The inner surface of the mounting portion 132 may form a circular ring shape. The mounting portion 132 may form the sixth boundary surface 133B along the circumferential direction of the central axis of the mounting portion 132.

The fourth boundary surface 133A and the sixth boundary surface 133B may form a stepped portion. The second boundary surface 421 and the sixth boundary surface 133B may form an angle of about 90 degrees.

The fifth boundary surface 442C and the sixth boundary surface 133B may face each other in the radial direction of the pipe portion 441. The fifth boundary surface 442C and the sixth boundary surface 133B may come into close contact with each other when the insertion portion 410 moves in a radial direction. Accordingly, the fifth boundary surface 442C and the sixth boundary surface 133B may block radial directional movement of the insertion portion 410 from the mounting portion 132.

A rear surface of the inlet 111 may form a seventh boundary surface 111A. The seventh boundary surface 111A may form a ring shape around a central axis of the inlet 111.

A front surface of the protrusion portion 442 may form an eighth boundary surface 442D. The eighth boundary surface 442D may form a ring shape around the central axis of the pipe portion 441. The eighth boundary surface 442D may be spaced apart from the seventh boundary surface 111A in the direction of the passage 401.

When the coupling part 440 is mounted in the outer surface of the insertion portion 410, the rear surface of the inlet 111 and the front surface of the protrusion portion 442 may face each other in the radial direction of the pipe portion 441. Accordingly, the seventh boundary surface 111A and the eighth boundary surface 442D may block movement of the main housing 110 and the first connection portion 420 in the direction of the passage 401.

The actions of the first to eighth boundary surfaces may be summarized as follows.

(1) The first boundary surface 442A and the second boundary surface 421 may enable relative rotation between the housing 100 and the connector 400 with the central axis of the insertion portion 410 as a center.

(2) The first boundary surface 442A and the second boundary surface 421 may block relative movement between the housing 100 and the connector 400 in the direction of the passage 401.

(3) The seventh boundary surface 111A and the eighth boundary surface 442D may block relative movement between the housing 100 and the connector 400 in the direction of the passage 401.

(4) The third boundary surface 442B and the fourth boundary surface 133A may block relative movement between the housing 100 and the connector 400 in the radial direction.

(5) The fifth boundary surface 442C and the sixth boundary surface 133B may block relative movement between the housing 100 and the connector 400 in the radial direction.

The vacuum cleaner of related art may have a limitation in that when the first connection member rotates, friction is focused on the contact surface between the first connection member and the second connection member. The focused friction may accelerate abrasion of components.

In the vacuum cleaner 1, the relative rotation between the housing 100 and the connector 400 may be made by action no. (1). The relative movement between the housing 100 and the connector 400 in the direction of the passage 401 may be dually blocked by actions no. (2) and (3). The relative movement between the housing 100 and the connector 400 in the radial direction may be dually blocked by actions no. (4) and (5).

That is, when the first connection portion 420 rotates about the central axis of the insertion portion 410, friction may be dispersed to between the first boundary surface 442A and the second boundary surface 421, between the third boundary surface 442B and the fourth boundary surface 133A, between the fifth boundary surface 442C and the sixth boundary surface 133B, and between the seventh boundary surface 111A and the eighth boundary surface 442D.

Accordingly, the vacuum cleaner 1 has an advantage in that when the first connection portion 420 rotates about the central axis of the insertion portion 410, the friction may not be focused on a specific area, which helps to prevent or reduce abrasion of components.

Figure 11:
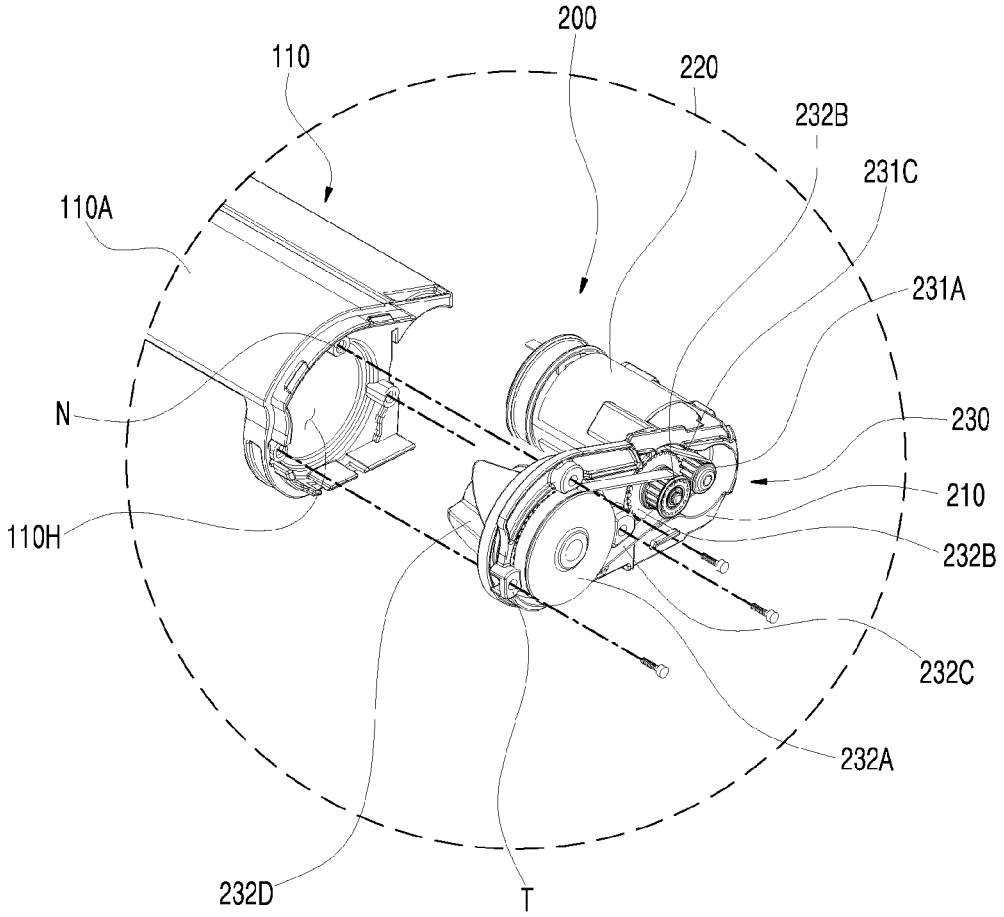
FIG. 11 is a partially exploded perspective view of the main housing of FIG. 5 and an example of a driver.
Figure 12:
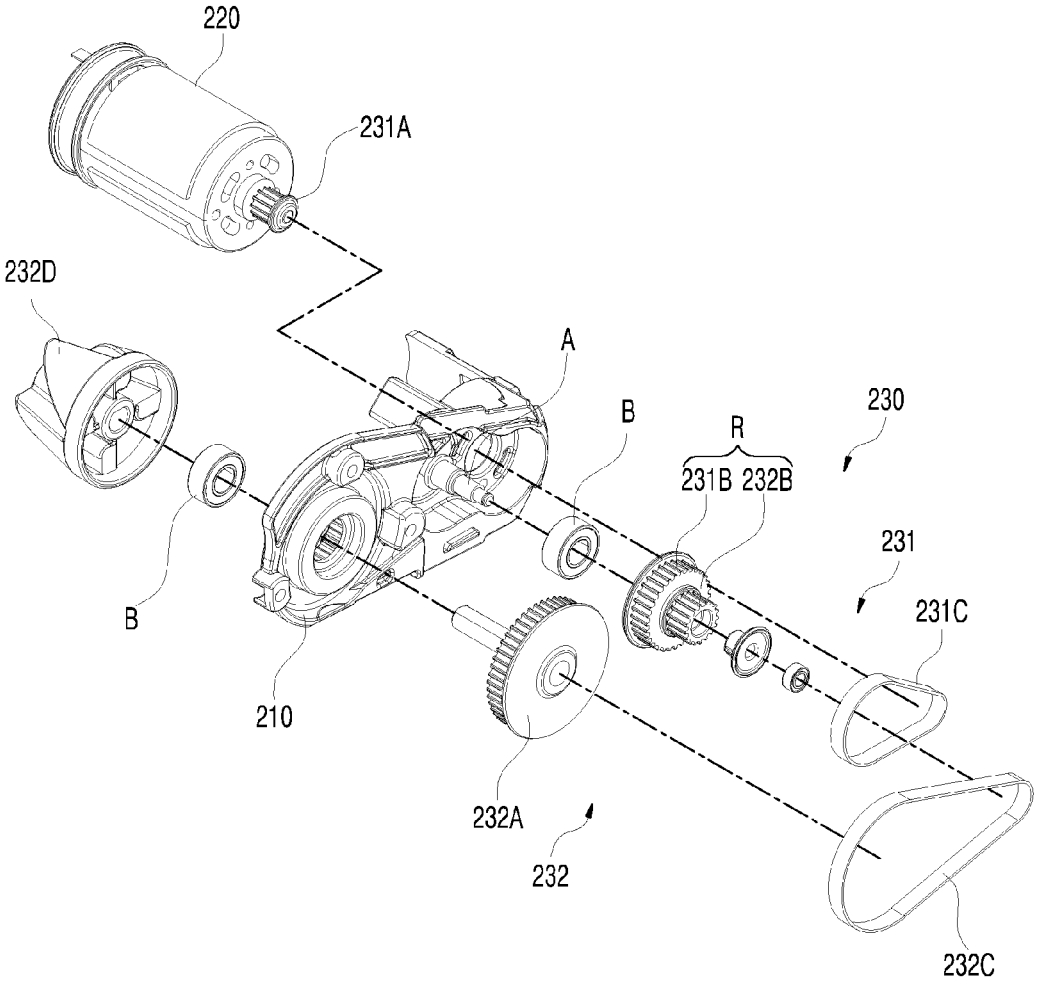
FIG. 12 is an exploded perspective view of the driver of FIG. 11.
Figure 13:
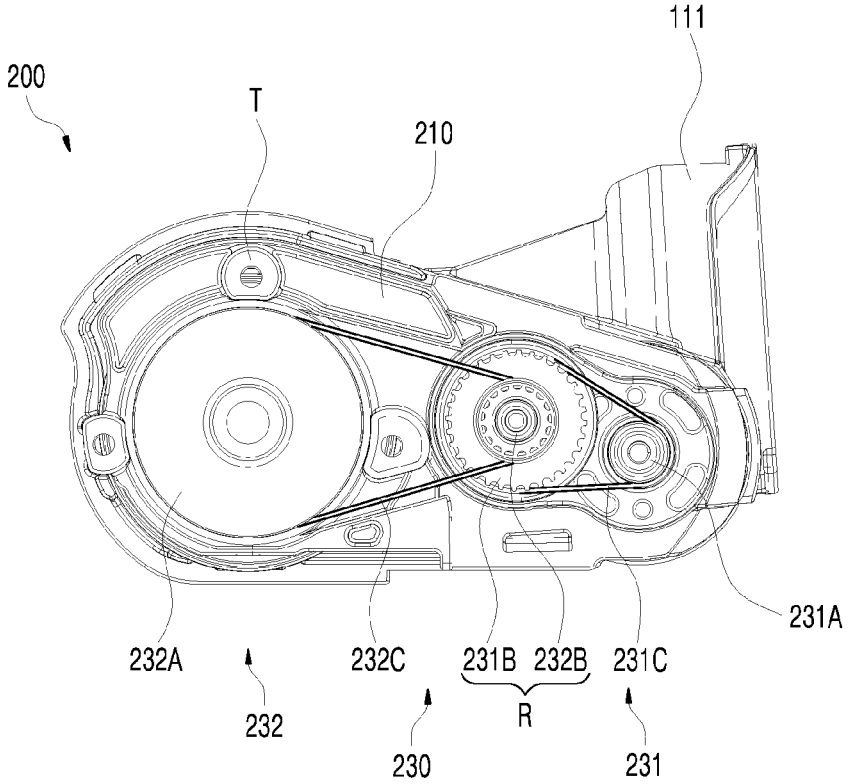
FIG. 13 is a side view of the driver of FIG. 11.

FIG. 11 is a partially exploded perspective view of the main housing 110 of FIG. 5 and an example of a driver 200. FIG. 12 is an exploded perspective view of the driver 200 of FIG. 11. FIG. 13 is a side view of the driver 200 of FIG. 11.

The driver 200 may rotate the rotating brush 310. The driver 200 may be coupled to one side surface (hereinafter referred to as a "left side surface") of the main housing 110. As illustrated in FIG. 4, the side surface cover 150 may cover the driver 200. The side surface cover 150 may be coupled to a left side surface of the housing 100 by means of a locking structure such as a hook. In the side surface cover 150, a hole may be formed for inflow and outflow of air.

As illustrated in FIG. 11, the driver 200 may include a bracket 210, a motor 220, and a transmission 230.

The bracket 210 may be coupled to the main housing 110 by means of a bolt. The bracket 210 may block the left side surface of the main housing 110. In the left side surface of the main housing 110, a plurality of fastening portions (N) to which a bolt is screw-coupled may be formed. In the bracket 210, a plurality of insertion portions (T) to which a bolt is inserted may be formed.

The motor 220 may generate a rotational force. The motor 220 may be provided as a brushless direct current (BLDC) motor. The motor 220 may be coupled to the bracket 210. When the bracket 210 is coupled to the main housing 110, the motor 220 may be positioned behind the rotating brush 310. A rotational axis of the motor 220 may be aligned with a rotational axis of the rotating brush 310.

As illustrated in FIGS. 12 and 13, the transmission 230 may transfer rotational motion of the motor 220 to the rotating brush 310. The transmission 230 may be mounted in the bracket 210. The transmission 230 may include a first belt transmission 231 and a second belt transmission 232.

The first belt transmission 231 may transfer the rotational motion of the motor 220 to a middle pulley (R). When the bracket 210 is coupled to the main housing 110, the middle pulley (R) may be disposed between the motor 220 and the rotating brush 310. An axis of the middle pulley (R) may be aligned with the rotational axis of the rotating brush 310.

A fixing shaft (A) may be coupled to the bracket 210. The middle pulley (R) may be rotatably mounted in the fixing shaft (A) by means of a bearing (B). A groove may be formed in the fixing shaft (A). A snap ring (S) may be mounted in the groove so as to help to prevent deviation of the middle pulley (R).

The middle pulley (R) may include a first middle pulley 231B and a second middle pulley 232B. The first middle pulley 231B and the second middle pulley 232B may rotate simultaneously. The first middle pulley 231B and the second middle pulley 232B may be integrally produced.

On outer surfaces of the first middle pulley 231B and the second middle pulley 232B, equally-spaced grooves may be formed as in a gear. That is, on outer surfaces of the first middle pulley 231B and the second middle pulley 232B, teeth may be formed as in a gear. The number of teeth of the first middle pulley 231B may be greater than the number of the teeth of the second middle pulley 232B.

As illustrated in FIGS. 12 and 13, the first belt transmission 231 may include a driving pulley 231A, the first middle pulley 231B, and a first belt 231C.

The first belt transmission 231 may be spaced apart from the rotating brush 310. That is, the driving pulley 231A, the first middle pulley 231B, and the first belt 231C may be positioned in the opposite side to the rotating brush 310 with respect to the bracket 210.

The driving pulley 231A may be coupled to an axis of the motor 220. On an outer surface of the driving pulley 231A, teeth may be formed as in a gear. The number of teeth of the first middle pulley 231B may be greater than the number of the teeth of the driving pulley 231A.

The first belt 231C may be wound around the driving pulley 231A and the first middle pulley 231B. The first belt 231C may be wound around the driving pulley 231A and the first middle pulley 231B in the manner of an open belt. Accordingly, the first belt 231C may transfer rotational motion of the driving pulley 231A to the first middle pulley 231B in the same rotational direction.

The first belt 231C may be provided as a timing belt. Accordingly, the first belt 231C may accurately transfer the rotational motion of the driving pulley 231A to the first middle pulley 231B.

As described above, the number of the teeth of the first middle pulley 231B may be greater than the number of the teeth of the driving pulley 231A. Accordingly, a torque of the first middle pulley 231B may be greater than a torque of the driving pulley 231A. Also, a rotation speed of the first middle pulley 231B may be slower than a rotation speed of the driving pulley 231A.

The second belt transmission 232 may transfer rotational motion of the middle pulley (R) to the rotating brush 310. The second belt transmission 232 may include a driven pulley 232A, the second middle pulley 232B, a second belt 232C, and a first shaft member 232D.

The second belt transmission 232 may be spaced apart from the rotating brush 310. That is, the driven pulley 232A, the second middle pulley 232B, and the second belt 232C may be positioned in the opposite side to the rotating brush 310 with respect to the bracket 210.

The first shaft member 232D may be inserted into the rotating brush 310. The first shaft member 232D may have a diameter in a range not exceeding a diameter of the rotating brush 310, regardless of the capacity of the motor 220.

The driven pulley 232A may be rotatably mounted in the bracket 210. A hole may be formed in the bracket 210. The bearing (B) may be mounted in the hole. A shaft of the driven pulley 232A may be rotatably coupled to the bearing (B). The shaft of the driven pulley 232A may pass through the bracket 210. The shaft of the driven pulley 232A may be aligned with the rotational axis of the rotating brush 310.

The first shaft member 232D may transfer rotational motion of the driven pulley 232A to the rotating brush 310. A second shaft member 313 may be provided at one end of the rotating brush 310.

Hereinafter, for easy understanding of the present disclosure, the direction of a rotational axis of the rotating brush 310 will be referred to as "axial direction."

The first shaft member 232D may be inserted into the second shaft member 313 to transfer rotational motion to the second shaft member 313. A rotational axis of the first shaft member 232D may be on the same line as that of the rotational axis of the rotating brush 310.

The first shaft member 232D may be coupled to the shaft of the driven pulley 232A from the opposite side to the driven pulley 232A. When the bracket 210 is coupled to the main housing 110, the first shaft member 232D may be disposed inside the main housing 110. As illustrated in FIG. 11, in the left side surface of the main housing 110, a hole 110H into which the first shaft member 232D is inserted may be formed.

On an outer surface of the driven pulley 232A, teeth may be formed as in a gear. The number of teeth of the driven pulley 232A may be greater than the number of the teeth of the second middle pulley 232B.

The second belt 232C may be wound around the driven pulley 232A and the second middle pulley 232B. The second belt 232C may be wound around the driven pulley 232A and the second middle pulley 232B in the manner of an open belt.

The second belt 232C may transfer rotational motion of the second middle pulley 232B to the driven pulley 232A in the same rotational direction. Accordingly, a rotational direction of the motor 220 is the same as a rotational direction of the first shaft member 232D.

The second belt 232C may be provided as a timing belt. Accordingly, the second belt 232C may accurately transfer rotational motion of the second middle pulley 232B to the driven pulley 232A.

As described above, the number of the teeth of the driven pulley 232A may be greater than the number of the teeth of the second middle pulley 232B. Accordingly, a torque of the driven pulley 232A may be greater than a torque of the second middle pulley 232B. In addition, a rotation speed of the driven pulley 232A may be smaller than a rotation speed of the second middle pulley 232B.

As a result, a rotation speed of the first shaft member 232D may be slower than a rotation speed of the motor 220, and a torque of the first shaft member 232D may be greater than a torque of the motor 220. The rotating brush 310 may rotate with relatively high torque, moving dust and debris on the floor to the suction space 101.

Figure 14:
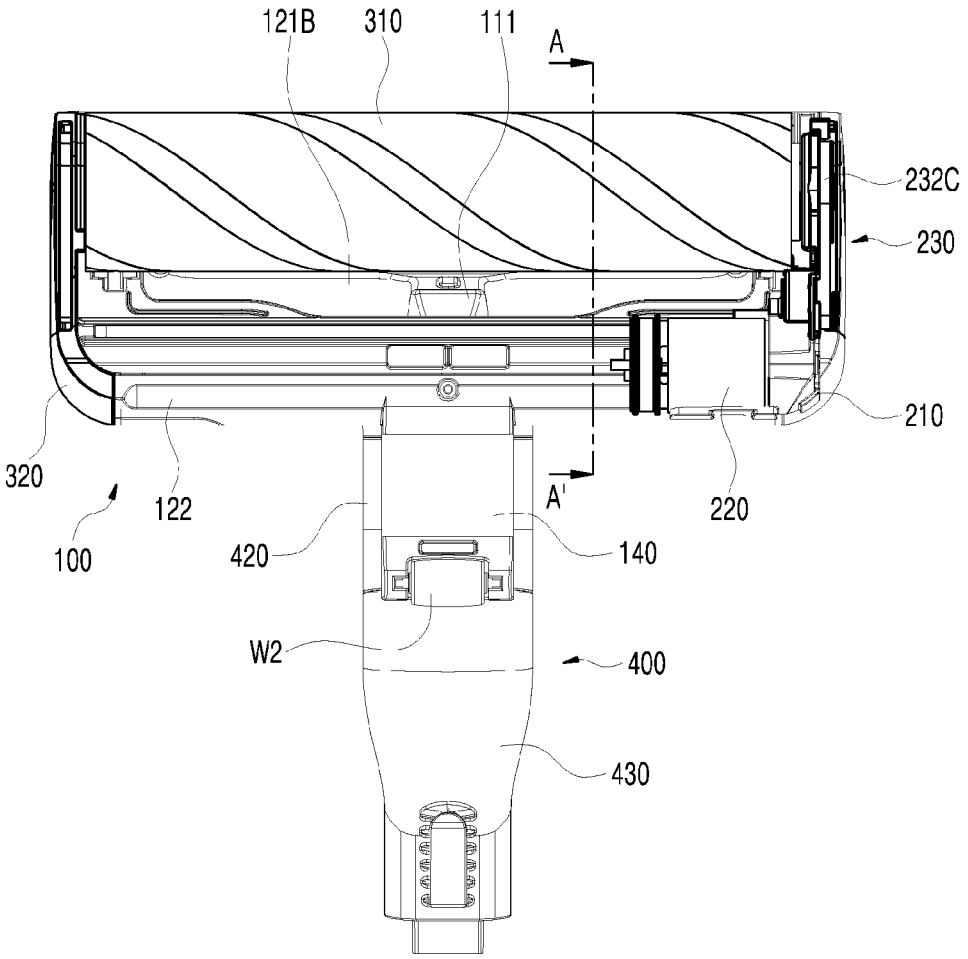
FIG. 14 is a bottom view of the suction nozzle of FIG. 2.
Figure 15:
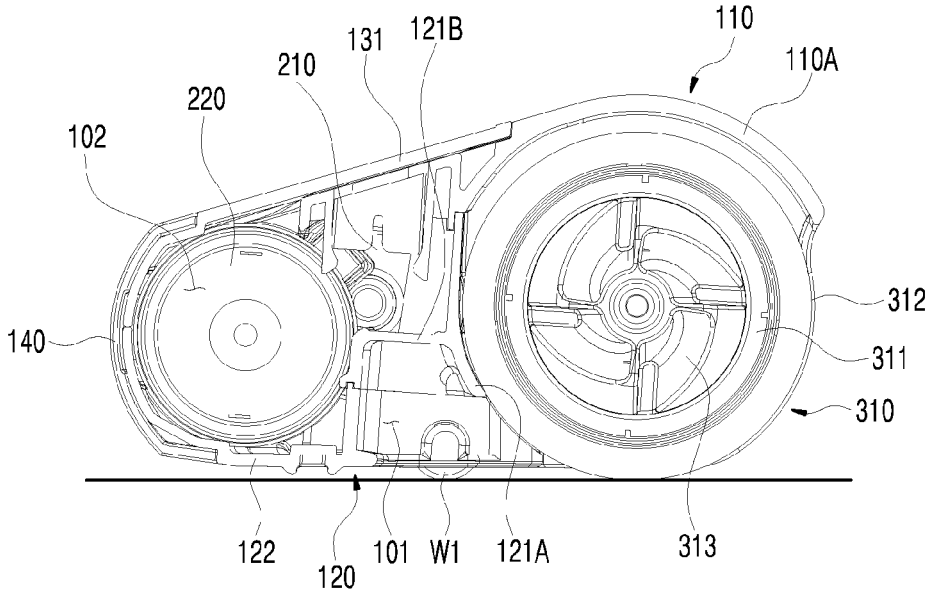
FIG. 15 is a cross-sectional view of the suction nozzle of FIG. 14 along the line from A to A'.

FIG. 14 is a bottom view of the suction nozzle 10 of FIG. 2. FIG. 15 is cross-sectional view of the suction nozzle 10 of FIG. 14 along the line from A to A'.

As illustrated in FIGS. 13 and 14, when the bracket 210 is coupled to the main housing 110, the motor 220 may be positioned behind the rotating brush 310. The rotational motion of the motor 220 may be transferred to the rotating brush 310, which is spaced apart from the motor 220, by the first belt transmission 231 and the second belt transmission 232.

The position of the middle pulley (R) may be determined depending on a distance between the motor 220 and the rotating brush 310. In addition, a length of the first belt 231C may be determined depending on a distance between the driving pulley 231A and the first middle pulley 231B and on diameters of the driving pulley 231A and the first middle pulley 231B. In addition, a length of the second belt 232C may be determined depending on a distance between the driven pulley 232A and the second middle pulley 232B and on diameters of the driven pulley 232A and the second middle pulley 232B.

Components of the vacuum cleaner 1 may have various specifications depending on the use of the vacuum cleaner 1. The capacity of the motor 220 and the diameter and the material of the rotating brush 310 may also be variously determined depending on the use of the vacuum cleaner 1.

For example, a vacuum cleaner for use in shops may include a motor with a greater capacity and a rotating brush with a greater diameter than those of a vacuum cleaner for use in a household. The material of the rotating brush may be determined from among metal and a synthetic resin depending on the use of the vacuum cleaner.

In the vacuum cleaner of related art, the diameter of the rotating brush may be considered when the motor is selected. Accordingly, the capacity of the motor may not be increased to a desired level in the related art.

In some examples, as for the vacuum cleaner for use in a household, a relatively lower height of the suction nozzle may be more advantageous in terms of usability. This is because a relatively lower height of the suction nozzle enables easy access to spaces with a relatively low height.

In related art, when determining the diameter of the rotating brush, the size and shape of the motor may be considered. Accordingly, the diameter of the rotating brush may not be decreased to a desired level in the related art.

In the vacuum cleaner 1, the driver 200 may be positioned outside the rotating brush 310. Accordingly, the present disclosure has an advantage in that the diameter of the rotating brush 310 may be determined regardless of the size and shape of the motor 220.

In addition, the present disclosure has an advantage in that the capacity of the motor 220 may be determined regardless of the diameter of the rotating brush 310.

When the suction nozzle 10 is moved back and forth, inertia may act on the suction nozzle 10 in the movement direction. In the vacuum cleaner of related art, the center of gravity of the suction nozzle is focused on the front side of the suction nozzle. Accordingly, when the suction nozzle is moved forwards, the back of the suction nozzle may be lifted by the inertia.

In addition, when the suction nozzle is inclined forwards, friction between the rotating cleaning unit and the floor increases. Excessive friction between the rotating cleaning unit and the floor may damage the floor.

In the vacuum cleaner 1, the driver 200 may be positioned behind the rotating brush 310. Accordingly, the center of gravity of the suction nozzle 10 of the present disclosure may be located further to the rear in comparison to the center of gravity of the suction nozzle of the vacuum cleaner of related art. Accordingly, in the vacuum cleaner 1, there is a lesser likelihood of the suction nozzle 10 becoming inclined forwards while the suction nozzle 10 is moved back and forth.

When the suction nozzle 10 is relatively heavy, the usability of the vacuum cleaner 1 may decrease. In the case of an upright type vacuum cleaner, wheels and a rotating brush in a housing are rubbed against the floor. Thus, a physically weak user, such as an elderly person or a child, may not be able to smoothly move the upright type vacuum cleaner.

Accordingly, there is a need to reduce the weight of the suction nozzle of the upright type vacuum cleaner. However, for conventional vacuum cleaners, a two-stage planetary gear set composed of many parts is generally used.

In the vacuum cleaner 1, the rotational motion of the motor 220 may be transferred to the rotating brush 310 by the first belt transmission 231 and the second belt transmission 232. A belt transmission transfers rotational motion through a simple pulley-belt structure. Accordingly, the transmission 230 may have advantages compared to the two-stage planetary gear set in that the number of parts and the weight of the transmission 230 significantly decrease.

As illustrated in FIG. 15, the mounting housing 130, along with the main housing 110, the lower housing 120, and the bracket 210, may form an isolated space 102. The isolated space 102 may be a space isolated from the suction space 101. The isolated space 102 may be positioned behind the rotating brush 310. The dust and debris in the suction space 101 may not be able to enter the isolated space 102.

When the bracket 210 is coupled to the main housing 110, the motor 220 may be provided in the isolated space 102. In addition, the first belt transmission 231 and the second belt transmission 232 may be isolated from the suction space 101 by the bracket 210. Accordingly, even when the driver 200 is not inserted into the rotating brush 310, contamination of the driver 200 caused by dust and debris may be prevented or reduced.

When the rotating brush 310 rubs the floor, the temperature of the rotating brush 310 may increase. In the vacuum cleaner of related art, the motor and the gear unit may be positioned within the rotating brush. Accordingly, the vacuum cleaner of related art has a limitation in that heat emission of the motor and the gear unit is relatively slow. Such an increase in the temperature of the motor and the gear unit directly leads to a decrease in performance and failure of the motor and gear unit.

In the vacuum cleaner 1, the driver 200 may be spaced apart from the rotating brush 310. In particular, the motor 220, the pulleys, and the belts, which generate heat energy, may be positioned in the isolated space 102 isolated from the rotating brush 310. The vacuum cleaner 1 has an advantage in that the heat energy of the motor 220, the pulleys, and the belts is quickly discharged through the bracket 210 and the housing 100.

Figure 16:
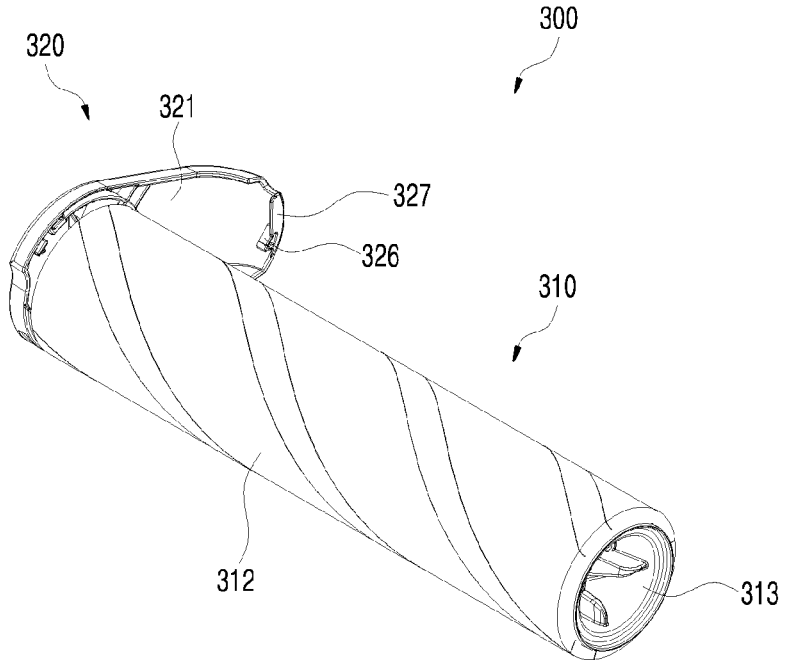
FIG. 16 is a perspective view of an example of a brush module of FIG. 4.
Figure 17:
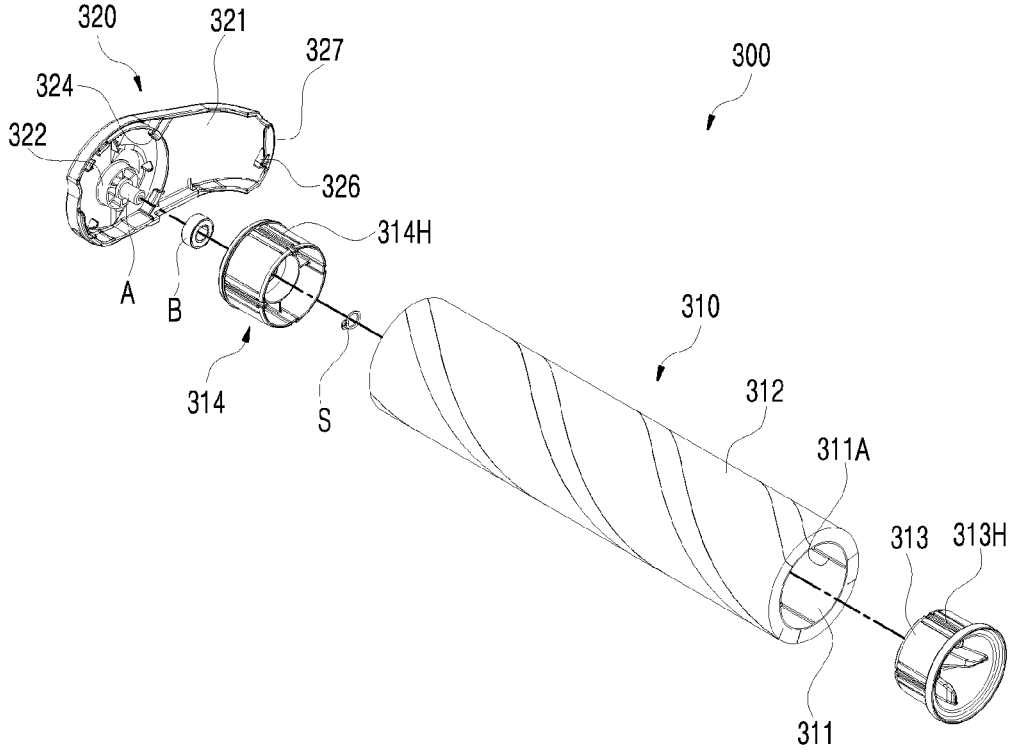
FIG. 17 is an exploded perspective view of the brush module of FIG. 16.
Figure 18:
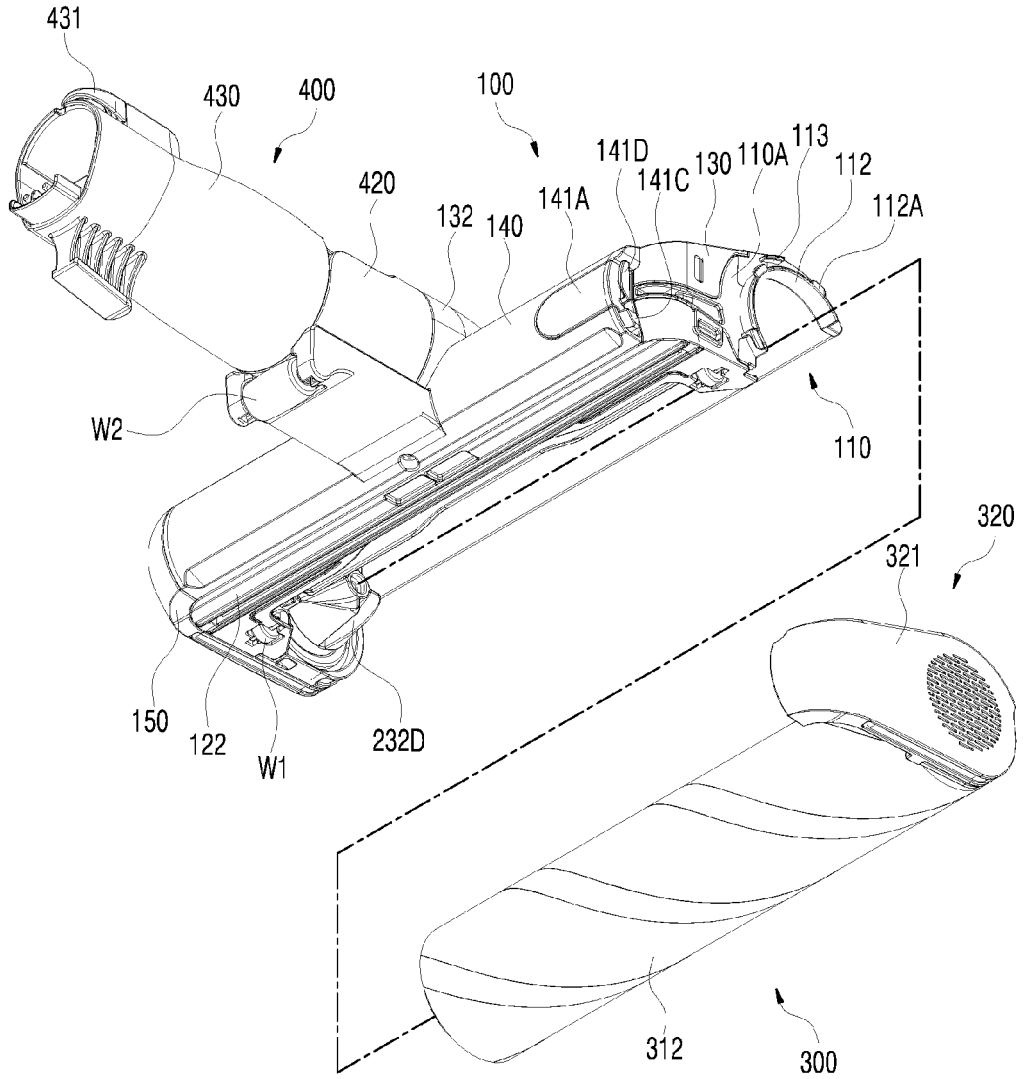
FIG. 18 is a perspective view of the suction nozzle of FIG. 2 with the brush module separated.

FIG. 16 is a perspective view of an example of a brush module 300 of FIG. 4. FIG. 17 is an exploded perspective view of the brush module 300 of FIG. 16. FIG. 18 is a perspective view of the suction nozzle 10 of FIG. 2 with the brush module 300 separated.

As illustrated in FIGS. 16 and 17, the brush module 300 may include the rotating brush 310 and the detachable cover 320.

The rotating brush 310 may push dust and debris on the floor to behind the rotating brush 310. The rotating brush 310 may include a body 311, a brush member 312, a second shaft member 313, and a third shaft member 314.

The body 311 may form the frame of the rotating brush 310. The body 311 may be formed in the shape of a hollow cylinder. A central axis of the body 311 may act as a central axis of the rotating brush 310. The body 311 may have a rotational inertia which is uniform along the circumferential direction thereof. The body 311 may be produced of a synthetic resin or metal.

The brush member 312 may be attached to an outer surface of the body 311. The brush member 312 may include a plurality of bristles. When the body 311 rotates, the plurality of bristles may lift dust and debris on the floor into the air. The plurality of bristles may include fiber bristles and metal bristles.

The fiber bristles and the metal bristles may be disposed randomly on the outer surface of the body 311. The fiber bristles and the metal bristles may be directly attached to the outer surface of the body 311. In some implementations, a fiber layer may be attached to the outer surface of the body 311. Then, the fiber bristles and the metal bristles may be attached to the fiber layer.

The fiber bristles may be produced of a synthetic resin, such as nylon. The metal bristles may include a conductive material. The metal bristles may be produced by coating bristles made of a synthetic resin with a conductive material.

Static electricity generated in the fiber bristle may be discharged to the floor or removed through the metal bristle. Accordingly, a phenomenon in which static electricity is transferred to the user may be avoided.

As illustrated in FIGS. 16 and 17, the second shaft member 313 may receive rotational motion of the first shaft member 232D. The second shaft member 313 may be provided in an opening at one side of the body 311. The second shaft member 313 may be inserted into the opening at one side of the body 311.

An insertion groove 313H may be formed on an outer surface of the second shaft member 313. A protruding portion 311A may be formed along the length direction of an inner surface of the body 311. When the second shaft member 313 is inserted into the opening of the body 311, the protruding portion 311A may be inserted into the insertion groove 313H. The protruding portion 311A may block relative rotation of the second shaft member 313.

In the second shaft member 313, a space into which the first shaft member 232D is inserted may be formed. When the rotating brush 310 moves in the axial direction thereof, the first shaft member 232D may be inserted into the second shaft member 313.

The first shaft member 232D and the second shaft member 313 may engage each other on a plurality of contact surfaces. When the first shaft member 232D and the second shaft member 313 engage each other, a rotational axis of the first shaft member 232D and a rotational axis of the second shaft member 313 may be on the same line.

Rotational motion of the first shaft member 232D may be transferred to the second shaft member 313 through the contact surfaces. With the first shaft member 232D and the second shaft member 313 engaging each other, the rotational axis of the rotating brush 310 and the rotational axis of the first shaft member 232D may be on the same line.

As illustrated in FIGS. 16 and 17, the third shaft member 314 may connect the body 311 to the detachable cover 320 in such a manner that the body 311 rotates. The third shaft member 314 may be provided in an opening at the other side of the body 311. The third shaft member 314 may be inserted into the opening at the other side of the body 311.

An insertion groove 314H may be formed on an outer surface of the third shaft member 314. A protruding portion 311A may be formed along the length direction of an inner surface of the body 311. When the third shaft member 314 is inserted into the opening of the body 311, the protruding portion 311A may be inserted into the insertion groove 314H. The protruding portion 311A may block relative rotation of the third shaft member 314.

A bearing (B) may be mounted in the third shaft member 314. A fixing shaft (A) may be provided in the detachable cover 320. The bearing (B) may support the fixing shaft (A) in such a manner that the fixing shaft (A) rotates. A groove may be formed in the fixing shaft (A). A snap ring (S) may be mounted in the groove to help to prevent separation of the third shaft member 314 and the fixing shaft (A).

The detachable cover 320 may be rotated about the rotational axis of the rotating brush 310 to be detachably coupled to the housing 100.

Figure 19:
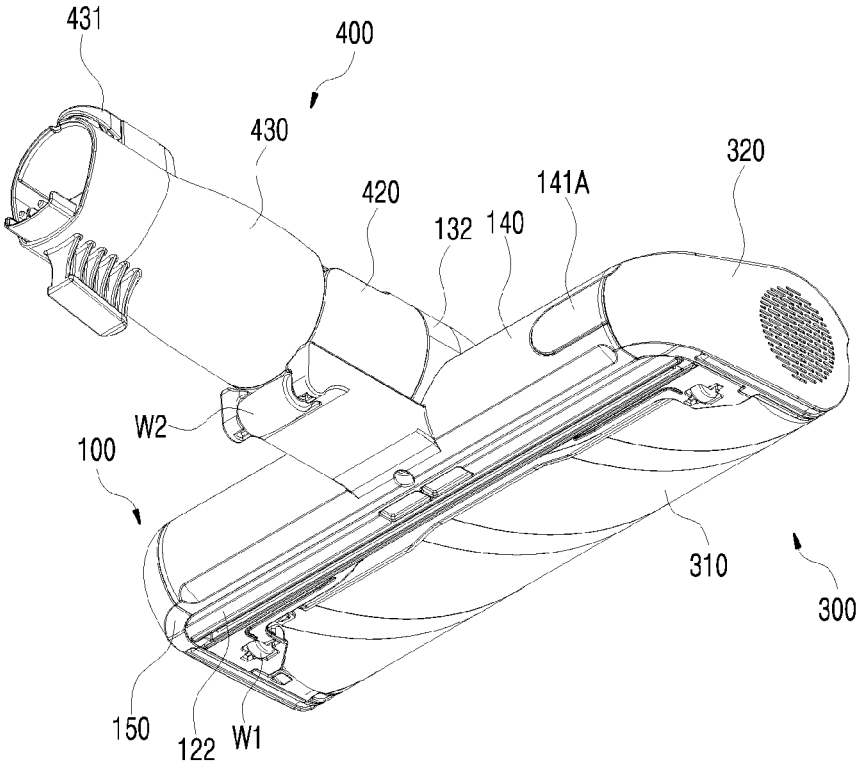
FIG. 19 is a perspective view of the suction nozzle of FIG. 2 with an example of a housing and an example of a detachable cover coupled to the housing.
Figure 20:
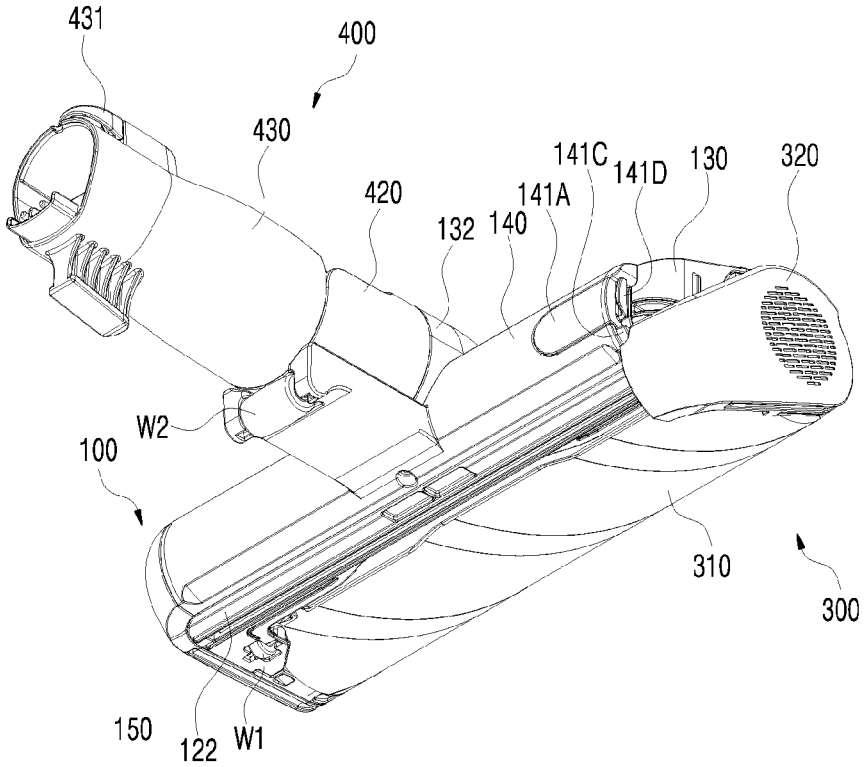
FIG. 20 is a perspective view of the suction nozzle of FIG. 2 with the housing and the detachable cover decoupled.

FIG. 19 is a perspective view of the suction nozzle 10 of FIG. 2 with the housing 100 and an example of a detachable cover 320 coupled. FIG. 20 is a perspective view of the suction nozzle 10 of FIG. 2 with the housing 100 and the detachable cover 320 decoupled.

Hereinafter, for easy understanding of the present disclosure, a state in which the detachable cover 320 is coupled to the housing 100 will be referred to as "coupled state." Also, a state in which the detachable cover 320 is decoupled from the housing 100 by rotating about the rotational axis of the rotating brush 310 will be referred to as "decoupled state."

In the decoupled state of FIG. 20, when the detachable cover 320 is pulled in the axial direction, the brush module 300 may be separated from the housing 100 as in FIG. 18.

Hereinafter, for easy understanding of the present disclosure, a rotational direction in which the detachable cover 320 is coupled to the housing 100 will be referred to as a "first rotational direction." A rotational direction in which the detachable cover 320 is decoupled from the housing 100 will be referred to as a "second rotational direction."

In the decoupled state of FIG. 20, when the detachable cover 320 is rotated in the first rotational direction, the detachable cover 320 may be coupled to the housing 100 as in FIG. 19.

Figure 21:
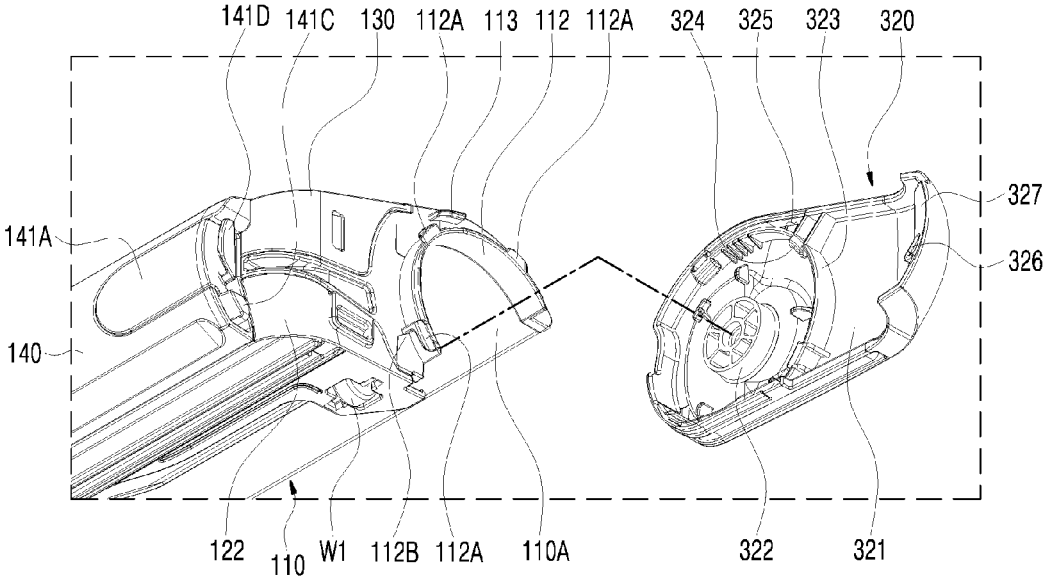
FIG. 21 is a perspective view of the suction nozzle of FIG. 18 without the rotating brush.
Figure 22:
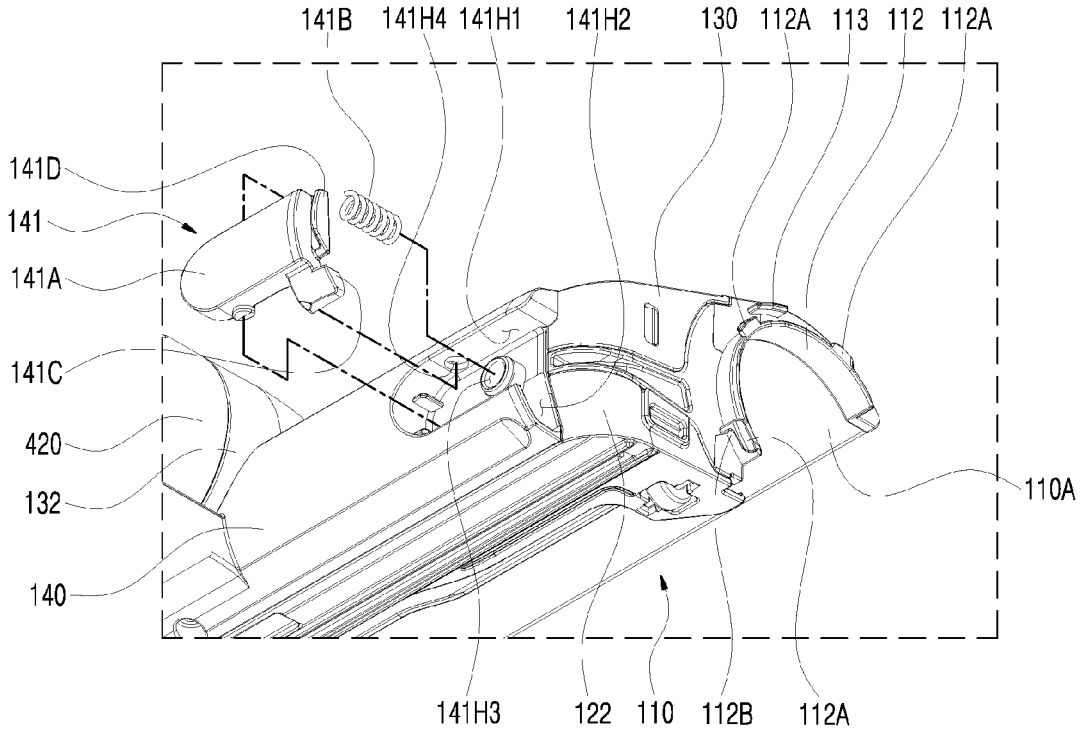
FIG. 22 is a perspective view of the suction nozzle of FIG. 21 and an example of a pressing button separated from the suction nozzle.
Figure 23:
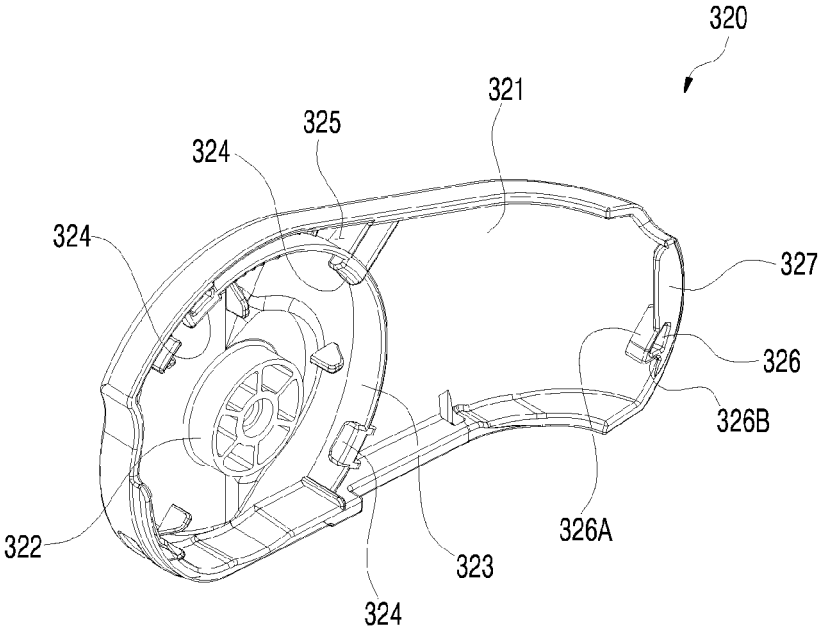
FIG. 23 is a perspective view of the detachable cover of FIG. 21.

FIG. 21 is a perspective view of the suction nozzle 10 of FIG. 18 without the rotating brush 310. FIG. 22 is a perspective view of the suction nozzle 10 of FIG. 21 with the pressing button 141 separated. FIG. 23 is a perspective view of the detachable cover 320 of FIG. 21.

As illustrated in FIGS. 21 and 22, at one side surface (hereinafter referred to as a "right side surface") of the main housing 110, a guide rail 112, a plurality of first walls 112A, a plurality of second walls 112B, and a second protrusion 113.

The guide rail 112 may be formed on the right side surface of the main housing 110. The guide rail 112 may be formed in the circumferential direction of the rotational axis of the first shaft member 232D.

An outer surface of the guide rail 112 may guide a rotation of first protrusions 324 about the rotational axis of the first shaft member 232D. The first protrusions 324 may be guided to the outer surface of the guide rail 112 and rotate in the first rotational direction and the second rotational direction.

The first walls 112A may be formed on the outer surface of the guide rail 112. The first walls 112A may protrude from the outer surface of the guide rail 112. The first protrusions 324 may rotate in the first rotational direction to enter between the first walls 112A and the main housing 110. Here, the first walls 112A may block axial-directional movement of the first protrusions 324.

The second walls 112B may be formed on the outer surface of the guide rail 112. The second walls 112B may protrude from the outer surface of the guide rail 112. In the coupled state, the second walls 112B may block rotation of the first protrusions 324 in the first rotational direction.

The second protrusion 113 may be formed on the right side surface of the main housing 110. The second protrusion 113 may be formed on the right side surface of the main housing 110. In the detachable cover 320, a guide groove 325 may be formed along an approximately circumferential direction of the fixing shaft (A).

An inner surface of the guide groove 325 may guide a rotation of the second protrusion 113 about the rotational axis of the rotating brush 310. In the coupled state and the decoupled state, the second protrusion 113 may be maintained in a state of being inserted into the guide groove 325.

As illustrated in FIGS. 21 and 22, the pressing button 141 may be mounted in the support housing 140. The pressing button 141 may selectively block rotation of the detachable cover 320. The pressing button 141 may include a button portion 141A, an elastic member 141B, a first blocking portion 141C, and a second blocking portion 141D.

The button portion 141A may form a surface that the user pushes on. A first mounting groove 141H1 into which the button portion 141A is inserted may be formed in the support housing 140.

A pair of shaft portions 141E may be formed in the button portion 141A. The pair of shaft portions 141E may be formed on both side surfaces of the button portion 141A. A pair of shaft grooves 141H4 may be formed on an inner surface of the first mounting groove 141H1. The pair of shaft grooves 141H4 may be formed on inner side surfaces of the first mounting groove 141H1 at both sides thereof.

The shaft portions 141E may be inserted into the shaft grooves 141H4. The button portion 141A may be rotated about the shaft portions 141E inserted into the shaft grooves 141H4.

The first blocking portion 141C may extend from the button portion 141A. In the coupled state, the first blocking portion 141C may block rotation of a third protrusion 326.

A second mounting groove 141H2 may be formed in the support housing 140. A part of the first blocking portion 141C may be inserted into the second mounting groove 141H2. The first blocking portion 141C may rotate within the second mounting groove 141H2 about the shaft portions 141E.

When the user pushes the button portion 141A, the pressing button 141 may be rotated about the shaft portions 141E. Here, the first blocking portion 141C may deviate from a rotational route of the third protrusion 326.

The elastic member 141B may be interposed between the button portion 141A and the housing 100. The elastic member 141B may form a force that pushes the button portion 141A outwards between the shaft portions 141E and the first blocking portion 141C.

Accordingly, when an external force applied to the button portion 141A is removed, the first blocking portion 141C may return to the rotational route of the third protrusion 326. In the support housing 140, a third mounting groove 141H3 into which the elastic member 141B is inserted may be formed.

The second blocking portion 141D may extend from the button portion 141A. In the coupled state, the second blocking portion 141D may block axial-directional movement of a fourth protrusion 327. In the coupled state, axial-directional movement of the fourth protrusion 327 may be blocked by the second blocking portion 141D.

The detachable cover 320 may rotatably support the rotating brush 310. The detachable cover 320 may be rotated about the rotational axis of the rotating brush 310 to be detachably coupled to the housing 100.

As illustrated in FIGS. 21 and 23, the detachable cover 320 may include a cover body 321, a hub 322, a protruding rib 323, a first protrusion 324, a third protrusion 326, and a fourth protrusion 327.

In the coupled state, the cover body 321 may cover a right side surface of the housing 100. A hole may be formed in the cover body 321 for inflow and outflow of air.

An edge portion of the cover body 321 may have an outline that is similar to the profile of the right side surface of the housing 100. The edge portion of the cover body 321 may protrude towards an edge of the right side surface of the housing 100. In the coupled state, the edge portion of the cover body 321 may come into close contact with the edge of the right side surface of the housing 100.

The hub 322 may be a portion to which the fixing shaft (A) is coupled. The fixing shaft (A) may be inserted into a mold when the detachable cover 320 is injection-molded. The hub 322 may be formed on an inner surface of the detachable cover 320. Here, the inner surface of the detachable cover 320 may be a surface that faces the housing 100.

The protruding rib 323 may be a portion that allows the first protrusion 324 to be spaced apart from the inner surface of the detachable cover 320 by a certain distance. The protruding rib 323 may be formed on the inner surface of the detachable cover 320. The protruding rib 323 may be formed in a circumferential direction of the hub 322.

A plurality of first protrusions 324 may be formed in the protruding rib 323. The first protrusions 324 may protrude from the protruding rib 323 towards the hub 322. The first protrusions 324 may be spaced apart from each other in a circumferential direction of the fixing shaft (A).

The first protrusions 324 may be spaced apart from the inner surface of the detachable cover 320 by a certain distance by means of the protruding rib 323. The first protrusions 324 may be guided to the outer surface of the guide rail 112 and rotate in the first rotational direction and the second rotational direction.

The third protrusion 326 may be formed on an edge of the inner surface of the detachable cover 320. When the detachable cover 320 is detachably coupled to the housing 100, the third protrusion 326 may be caught by the first blocking portion 141C. The third protrusion 326 may be spaced farther apart from the fixing shaft (A), compared to the first protrusion 324.

The third protrusion 326, along with an inclined surface 326A, may form a catching surface 326B. When the detachable cover 320 is rotated about the fixing shaft (A), the first blocking portion 141C may interfere with rotation of third protrusion 326.

When the detachable cover 320 is rotated in the first rotational direction, the inclined surface 326A may form a gentle inclination which pushes the first blocking portion 141C towards the central axis of the rotating brush 310. The first blocking portion 141C may be pushed only towards the central axis. Accordingly, when the detachable cover 320 is rotated in the first rotational direction, the first blocking portion 141C may be pushed by the catching surface 326B.

When the detachable cover 320 is rotated in the second rotational direction in the coupled state, the catching surface 326B may form a surface that pushes the first blocking portion 141C in a direction that is approximately perpendicular to the central axis. The first blocking portion 141C may be pushed only towards the central axis. Accordingly, when the detachable cover 320 is rotated in the second rotational direction in the coupled state, the first blocking portion 141C may not be pushed.

In order to rotate the detachable cover 320 in the second rotational direction in the coupled state, the user should push the pressing button 141 in such a manner that the first blocking portion 141C deviates from the rotational route of the third protrusion 326.

A fourth protrusion 327 may be formed on an edge of the inner surface of the detachable cover 320. The fourth protrusion 327 may be positioned further forward in the first rotational direction than the third protrusion 326. In the coupled state, axial-directional movement of the fourth protrusion 327 may be blocked by the second blocking portion 141D. In the coupled state, a rotation of the fourth protrusion 327 in the first rotational direction may be blocked by the support housing 140.

Figure 24:
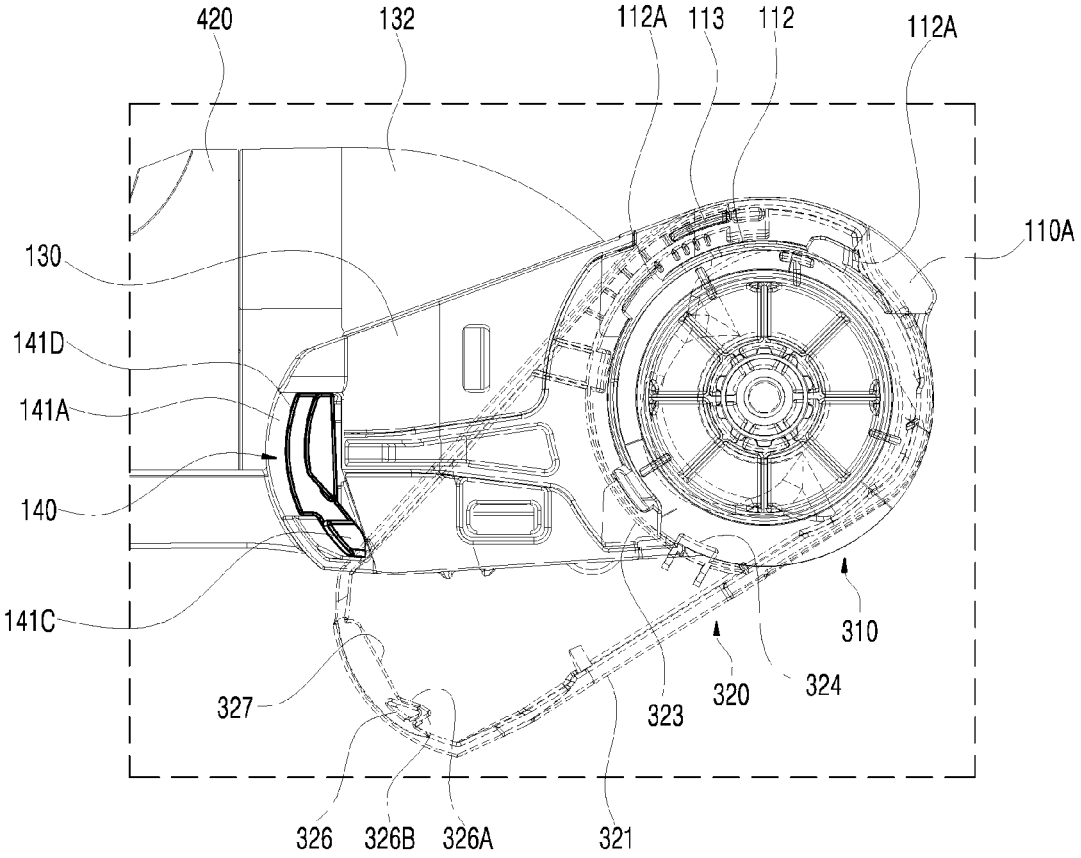
FIG. 24 is a side view of the suction nozzle of FIG. 20.
Figure 25:
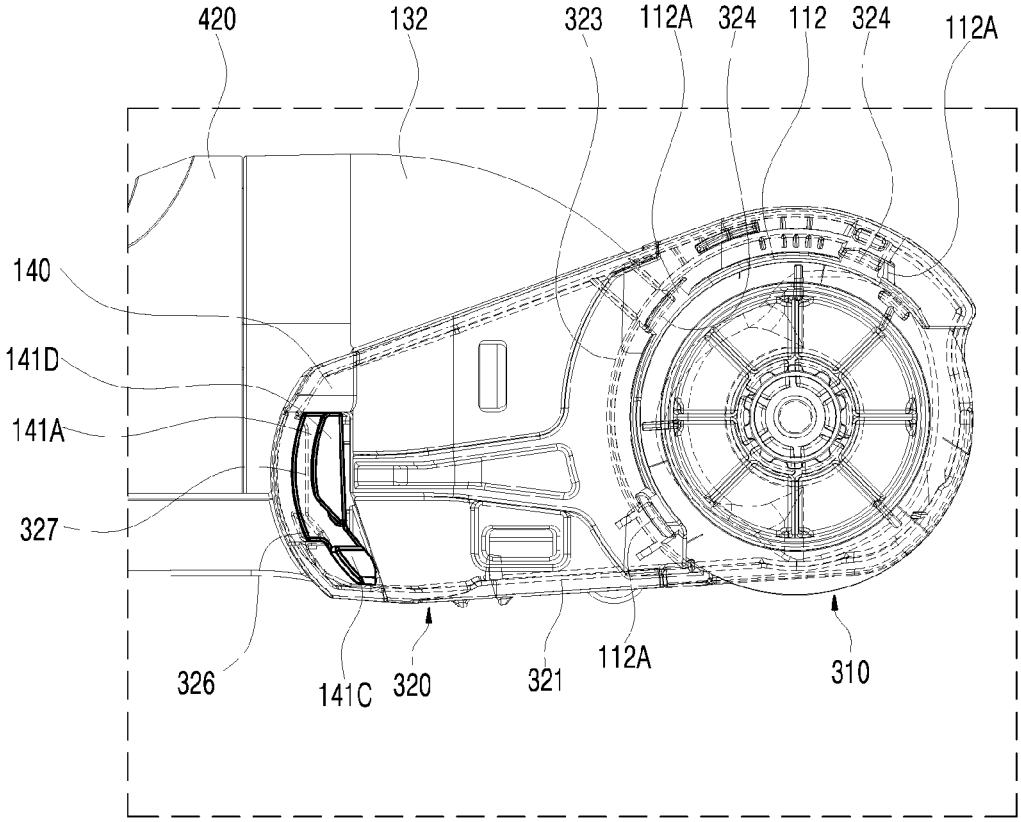
FIG. 25 is a side view of the suction nozzle of FIG. 19 with the pressing button pressed.
Figure 26:
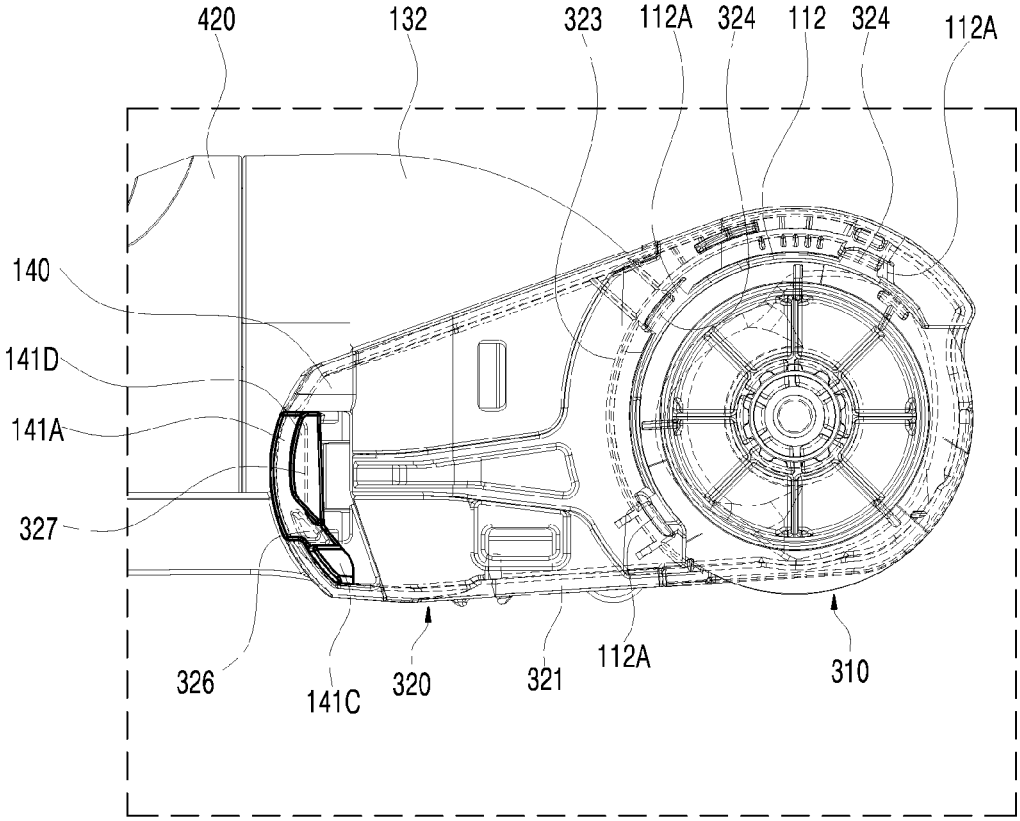
FIG. 26 is a side view of the suction nozzle of FIG. 19.

FIG. 24 is a side view of the suction nozzle 10 of FIG. 20. FIG. 25 is a side view of the suction nozzle 10 of FIG. 19 with an example of a pressing button 141 that is pressed. FIG. 26 is a side view of the suction nozzle 10 of FIG. 19.

The process of mounting the brush module 300 in the housing 100 is as follows.

First, move the brush module 300 in the axial direction to insert the first shaft member 232D into the second shaft member 313. When the first shaft member 232D is inserted into the second shaft member 313, the detachable cover 320 may be in a state of being decoupled from the housing 100, that is, in the decoupled state described in detail above.

As illustrated in FIG. 24, in the decoupled state, the protruding rib 323 may surround the guide rail 112. In the decoupled state, the second protrusion 113 may be inserted into the guide groove 325.

Thereafter, the user may rotate the detachable cover 320 in the first rotational direction. Then, the first protrusions 324 may be guided to the outer surface of the guide rail 112 to rotate in the first rotational direction. The second protrusion 113 may move inside the guide groove 325 with the rotational axis of the rotating brush 310 as a center.

As illustrated in FIG. 25, in the process in which the detachable cover 320 is rotated in the first rotational direction, the third protrusion 326 may get the first blocking portion 141C to deviate from the rotational route through the inclined surface 326A, and then the third protrusion 326 may keep rotating in the first rotational direction.

As illustrated in FIG. 26, when the fourth protrusion 327 is blocked by the support housing 140, the rotation of the detachable cover 320 in the first rotational direction may be completed. In this state, the detachable cover 320 may be in a state of being coupled to the housing 100, that is, in the coupled state described in detail above.

In the coupled state, the third protrusion 326 may be blocked by the first blocking portion 141C, which blocks a rotation of the third protrusion 326 in the second rotational direction. In the coupled state, an axial-directional movement of the fourth protrusion 327 may be blocked by the second blocking portion 141D.

Here, the first walls 112A may block axial-directional movement of the first protrusions 324. The second walls 112B may block rotation of the first protrusions 324 in the first rotational direction.

The process of separating the brush module 300 from the housing 100 is as follows.

As illustrated in FIG. 25, the user may firstly press the pressing button 141. When the user presses the pressing button portion 141A, the first blocking portion 141C may deviate from the rotational route of the third protrusion 326.

Here, the user may rotate the detachable cover 320 in the second rotational direction. Then, the third protrusion 326 may rotate in the second rotational direction about the fixing shaft (A) to be spaced apart from the first blocking portion 141C.

The second protrusion 113 may move inside the guide groove 325 with the rotational axis of the rotating brush 310 as a center.

As illustrated in FIG. 24, the first protrusions 324 may be guided to the outer surface of the guide rail 112 to rotate in the second rotational direction. The first protrusions 324 may rotate in the second rotational direction to deviate from between the main housing 110 and the first walls 112A. In this state, the detachable cover 320 may be in a state of being decoupled from the housing 100, that is, in the decoupled state described in detail above.

In the vacuum cleaner of related art, a coupling force between the side surface cover and the main body is generated by means of a locking structure such as a hook. Such a coupling structure as a locking structure is a relatively simple structure. However, in a locking structure, when the direction of the suction nozzle is changed, it is difficult to stably support an axial-directional force applied to a rotating cleaning unit.

In the vacuum cleaner 1, when the detachable cover 320 is rotated in the second rotational direction while pressing the pressing button 141, the housing 100 and the detachable cover 320 may be easily decoupled. In addition, in the decoupled state, when the detachable cover 320 is rotated in the first rotational direction, a coupling force may be generated between the housing 100 and the detachable cover 320.

Furthermore, in the coupled state, the first walls 112A may block the axial-directional movement of the first protrusions 324. The first walls 112A may be spaced apart from each other in the circumferential direction of the fixing shaft (A).

The first walls 112A, disposed along the circumferential direction of the fixing shaft (A), may disperse and support the axial-directional force that is applied to the rotating brush 310 when the direction of the suction nozzle 10 is changed.

The axial-directional movement of the fourth protrusion 327 may be blocked by the second blocking portion 141D. In addition, in the coupled state, the second walls 112B may block rotation of the first protrusions 324 in the first rotational direction.

The third protrusion 326 may be blocked by the first blocking portion 141C, which blocks a rotation of the third protrusion 326 in the second rotational direction. The rotation of the fourth protrusion 327 may be blocked by the support housing 140, which blocks a rotation of the fourth protrusion 327 in the first rotational direction.

That is, without pressing the pressing button 141, the detachable cover 320 cannot be moved in the axial direction or rotated about the fixing shaft (A). The vacuum cleaner 1 may form a strong coupling structure in which the housing 100 and the detachable cover 320 cannot easily be decoupled by an external force without pressing the pressing button 141.

Figure 27:
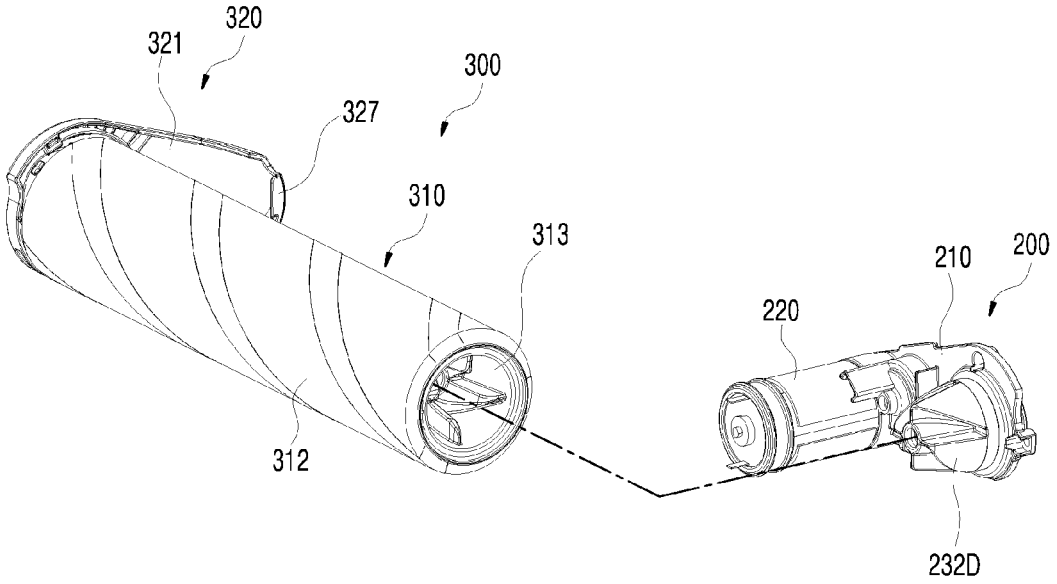
FIG. 27 is a perspective view of the brush module and the driver of the suction nozzle of FIG. 19.
Figure 28:
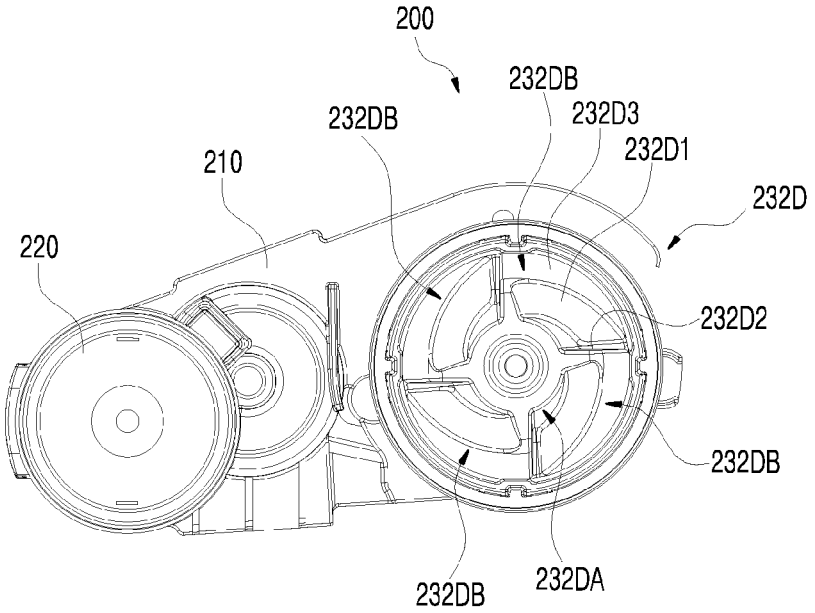
FIG. 28 is a side view of the driver of FIG. 27.
Figure 29:
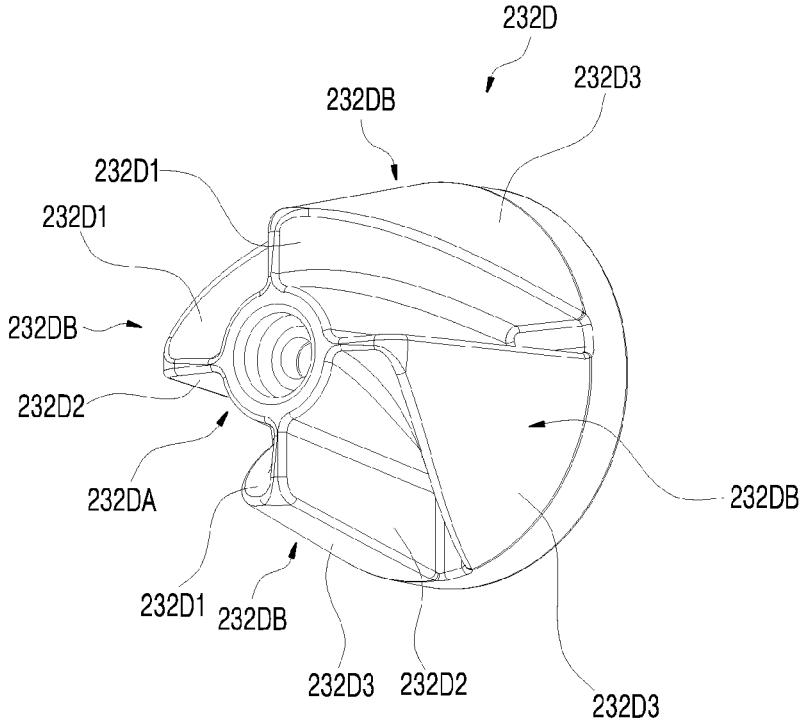
FIG. 29 is a perspective view of an example of a first shaft member of FIG. 28.

FIG. 27 is a perspective view of the brush module 300 and the driver 200 of the suction nozzle 10 of FIG. 19. FIG. 28 is a side view of the driver 200 of FIG. 27. FIG. 29 is a perspective view of the first shaft member 232D of FIG. 28.

Hereinafter, for easy understanding of the present disclosure, an axial direction in which the rotating brush 310 moves so that the first shaft member 232D is inserted into the second shaft member 313 will be referred to as a "first axial direction." Also, the opposite direction to the first axial direction will be referred to as a "second axial direction."

The first shaft member 232D may transfer rotational motion to the second shaft member 313. In the second shaft member 313, a space into which the first shaft member 232D is inserted may be formed.

When the rotating brush 310 moves in the first axial direction, the first shaft member 232D may be inserted into the second shaft member 313. When the first shaft member 232D is inserted into the second shaft member 313, the first shaft member 232D and the second shaft member 313 may engage each other to come into contact with each other on a plurality of contact surfaces.

Rotational motion of the first shaft member 232D may be transferred to the second shaft member 313 through the contact surfaces. With the first shaft member 232D and the second shaft member 313 engaging each other, a rotational axis of the rotating brush 310 and a rotational axis of the first shaft member 232D may be on the same line.

The driver of the vacuum cleaner of related art may be coupled to the rotating cleaning unit within the rotating cleaning unit by means of the fixing member. Accordingly, it may be difficult to disassemble and reassemble the driver and the rotating cleaning unit in the vacuum cleaner of related art.

In the vacuum cleaner 1, when the detachable cover 320 is rotated while pressing the pressing button 141 for the decoupled state, the engagement between the first shaft member 232D and the second shaft member 313 may be released. Accordingly, the user may easily decouple the rotating brush 310 and the driver 200 of the vacuum cleaner 1.

As illustrated in FIGS. 28 and 29, the first shaft member 232D may include a hub 232DA and a plurality of first transfer portions 232DB.

The hub 232DA may be a portion to which a shaft of the driven pulley 232A (hereinafter referred to as a "pulley shaft") is coupled. The first shaft member 232D may rotate about the hub 232DA.

The first transfer portions 232DB may be axisymmetric with each other about the pulley shaft (PA). The number of the first transfer portions 232DB may be variously determined. For example, the number of the first transfer portions 232DB may be four.

A single first transfer portion 232DB may form three surfaces. A single first transfer portion 232DB may form a first surface 232D1, a third surface 232D2, and a fifth surface 232D3.

First surfaces 232D1 of the first transfer portions 232DB may extend from a side surface of the hub 232DA in an approximately radial direction of the pulley shaft (PA). The first surfaces 232D1 of the first transfer portions 232DB may be surfaces that transfer the rotational motion of the first shaft member 232D to the second shaft member 313. The first surfaces 232D1 may form a relatively small angle with a radial direction of the pulley shaft (PA).

The first surfaces 232D1 may form a spiral around the pulley shaft (PA). The first surfaces 232D1 may be positioned along the rotational direction of the first shaft member 232D towards the first axial direction. The first surfaces 232D1 may be axisymmetric with each other about the hub 232DA.

A surface area of the first surfaces 232D1 may increasingly decrease towards the second axial direction. The first surfaces 232D1 may be positioned increasingly closer to the rotational axis of the rotating brush 310 towards the second axial direction.

Third surfaces 232D2 of the first transfer portions 232DB may extend from a side surface of the hub 232DA in an approximately radial direction of the pulley shaft (PA). The third surfaces 232D2 may form a relatively small angle with the radial direction of the pulley shaft (PA).

The third surfaces 232D2 may be surfaces that receive a rotational inertia of the rotating brush 310. Rotational inertia refers to the property by which a rotating object maintains its state of uniform rotational motion.

The second shaft member 313 may receive the rotational force of the motor 220 through the first shaft member 232D. However, if a rotation speed of the second shaft member 313 is greater than a rotation speed of the first shaft member 232D, the rotational inertia of the rotating brush 310 may be transferred to the first shaft member 232D.

That is, after an operation of the driver 200 stops, the rotational inertia of the rotating brush 310 may be transferred to the first shaft member 232D through the second shaft member 313 until the rotation of the rotating brush 310 stops.

In some examples, if the rotation speed of the rotating brush 310 is adjusted, the rotational inertia of the rotating brush 310 may be transferred to the first shaft member 232D through the second shaft member 313 in the process where a rotation speed of the motor 220 decreases.

The third surfaces 232D2 may form a plane aligned with the axial direction of the rotating brush 310. The third surfaces 232D2 may be axisymmetric with each other about the pulley shaft (PA).

The surface area of the third surfaces 232D2 may increasingly decrease towards the second axial direction. The third surfaces 232D2 may be positioned increasingly closer to the rotational axis of the rotating brush 310 towards the second axial direction.

When the first shaft member 232D is inserted into the second shaft member 313, a single second transfer portion 313B may be inserted between a first surface 232D1 and a third surface 232D2 that are adjacent to each other.

The fifth surface 232D3 may be a surface connecting the first surface 232D1 and the third surface 232D2. The fifth surface 232D3 may connect the first surface 232D1 and the third surface 232D2 in a circumferential direction of the pulley shaft (PA). Fifth surfaces 232D3 of the first transfer portions 232DB may be axisymmetric with each other about the pulley shaft (PA).

The surface area of the fifth surfaces 232D3 may increasingly decrease towards the second axial direction. The fifth surfaces 232D3 may be positioned increasingly closer to the rotational axis of the rotating brush 310 towards the second axial direction.

Figure 30:
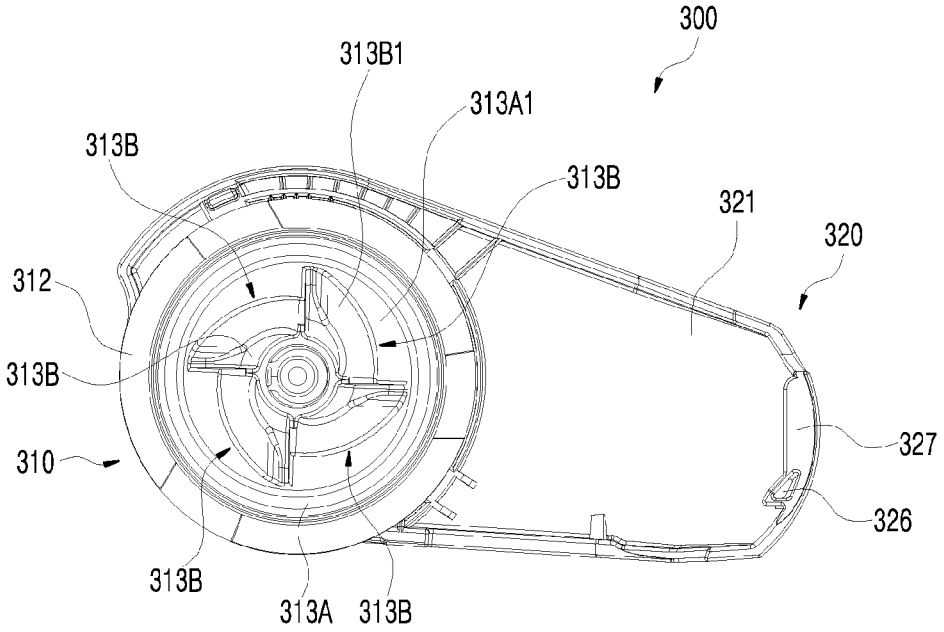
FIG. 30 is a side view of the brush module of FIG. 27.
Figure 31:
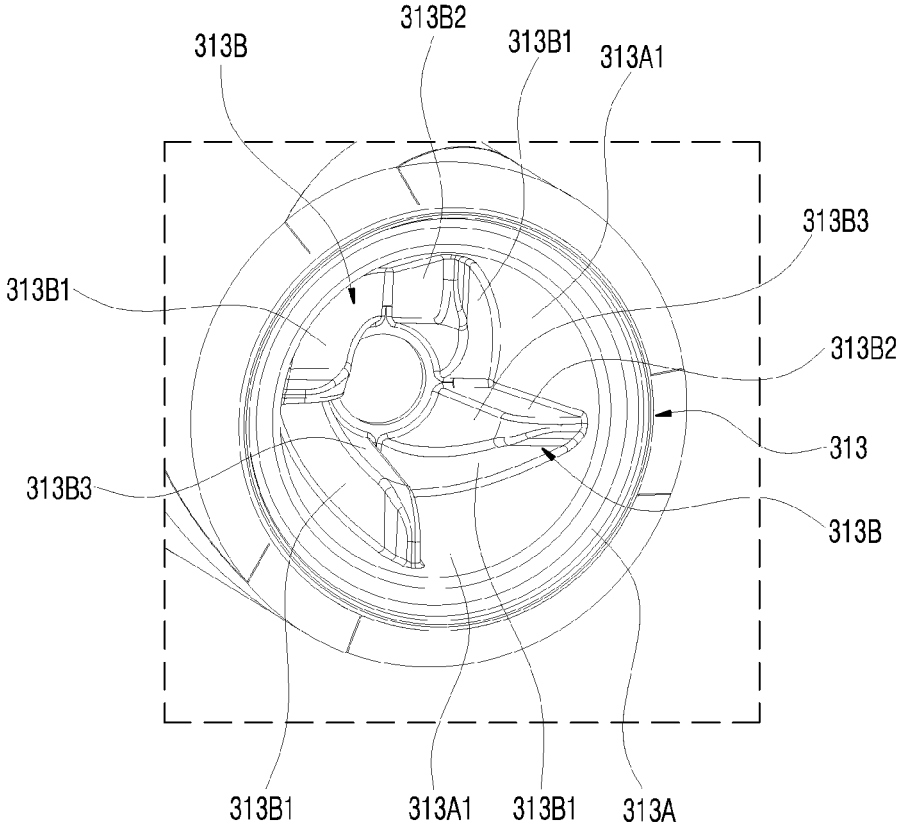
FIG. 31 is a partial perspective view of an example of a second shaft member of FIG. 30.

FIG. 30 is a side view of the brush module 300 of FIG. 27. FIG. 31 is a partial perspective view of the second shaft member 313 of FIG. 30.

As illustrated in FIGS. 30 and 31, the second shaft member 313 may include a shaft body 313A and a plurality of second transfer portions 313B.

The shaft body 313A may be inserted into an opening at one side of the body 311. An insertion groove 313H may be formed on an outer surface of the shaft body 313A. A protruding portion 311A may be formed along the length direction of an inner surface of the body 311.

When the shaft body 313A is inserted into the opening of the body 311, the protruding portion 311A may be inserted into the insertion groove 313H. The protruding portion 311A may block relative rotation of the shaft body 313A.

The second transfer portions 313B may be axisymmetric with each other about the pulley shaft (PA). When the first shaft member 232D is inserted into the second shaft member 313, the first shaft member 232D and the second shaft member 313 may engage each other to come into contact with each other on a plurality of contact surfaces. Accordingly, the number of the second transfer portions 313B may be equal to the number of the first transfer portions 232DB.

A single second transfer portion 313B may form three surfaces. A single second transfer portion 313B may form a second surface 313B1, a fourth surface 313B2, and a seventh surface 313B3. The shaft body 313A may form a sixth surface 313A1.

Second surfaces 313B1 of the second transfer portions 313B may extend from an inner surface of the shaft body 313A in an approximately radial direction of the pulley shaft (PA). The second surfaces 313B1 may form a relatively small angle with the radial direction of the pulley shaft (PA).

The second surfaces 313B1 may form a spiral around the pulley shaft (PA). The second surfaces 313B1 may be positioned along the rotational direction of the first shaft member 232D towards the first axial direction.

The second surfaces 313B1 may be axisymmetric with each other about the shaft body 313A. The second surfaces 313B1 may be positioned increasingly closer to the rotational axis of the rotating brush 310 towards the second axial direction.

Figure 32:
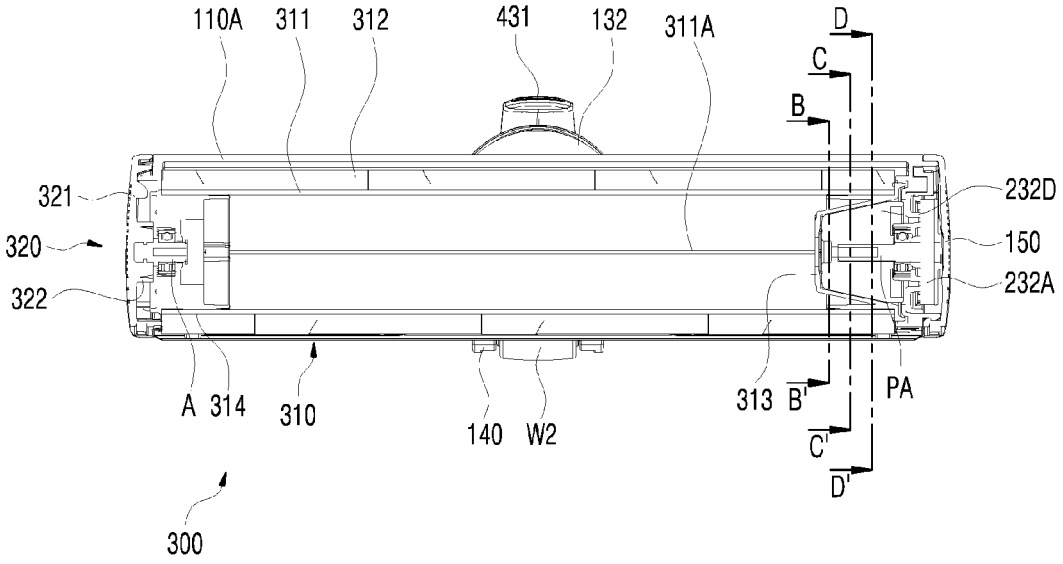
FIG. 32 is a cross-sectional view of the suction nozzle of FIG. 19.
Figure 33:
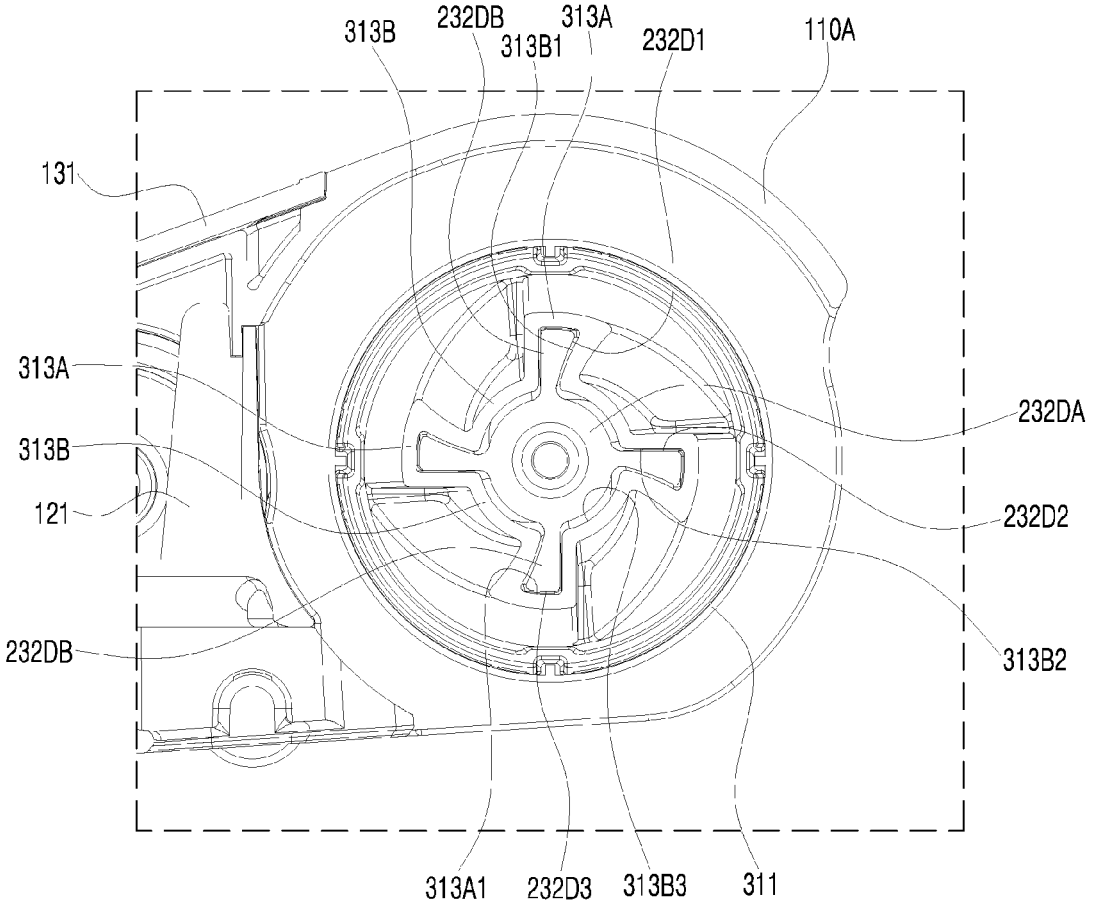
FIG. 33 is a cross-sectional view of the suction nozzle of FIG. 32 along the line from B to B'.
Figure 34:
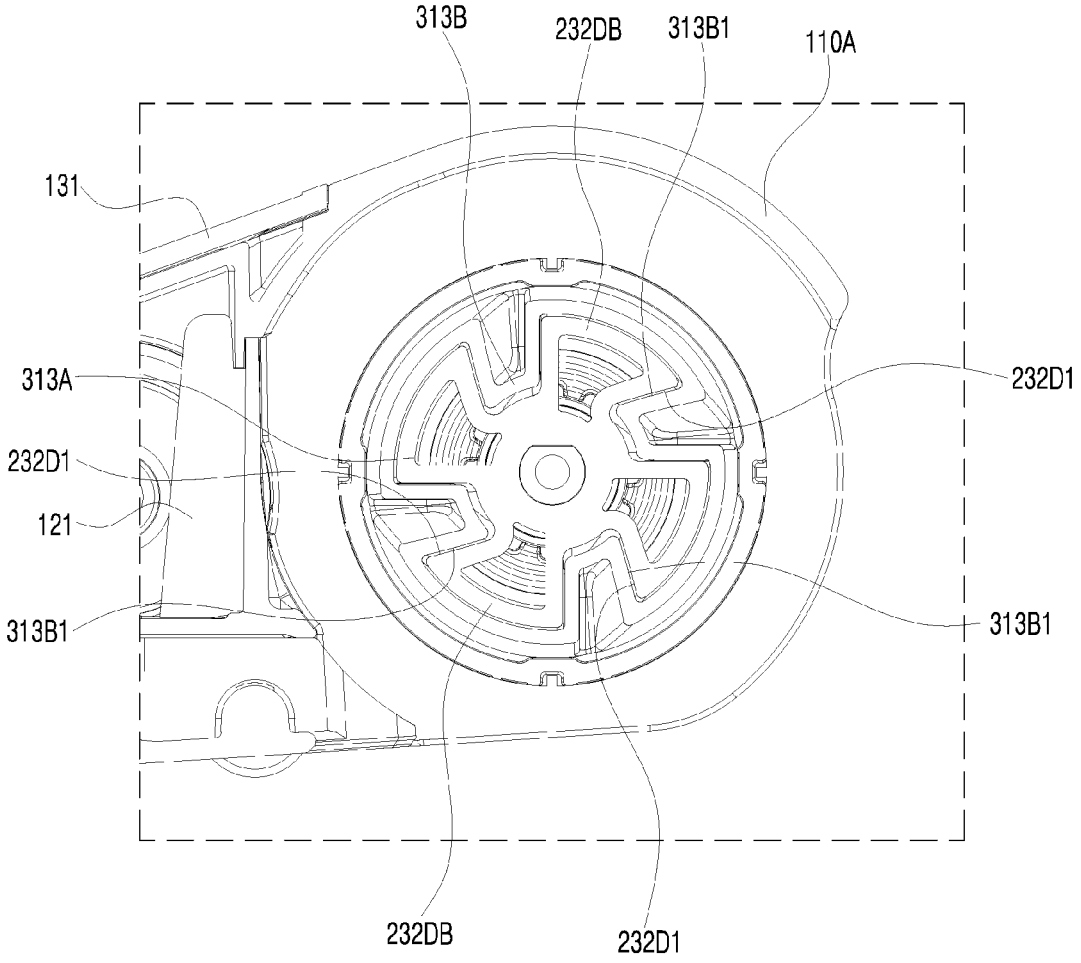
FIG. 34 is a cross-sectional view of the suction nozzle of FIG. 32 along the line from C to C'.
Figure 35:
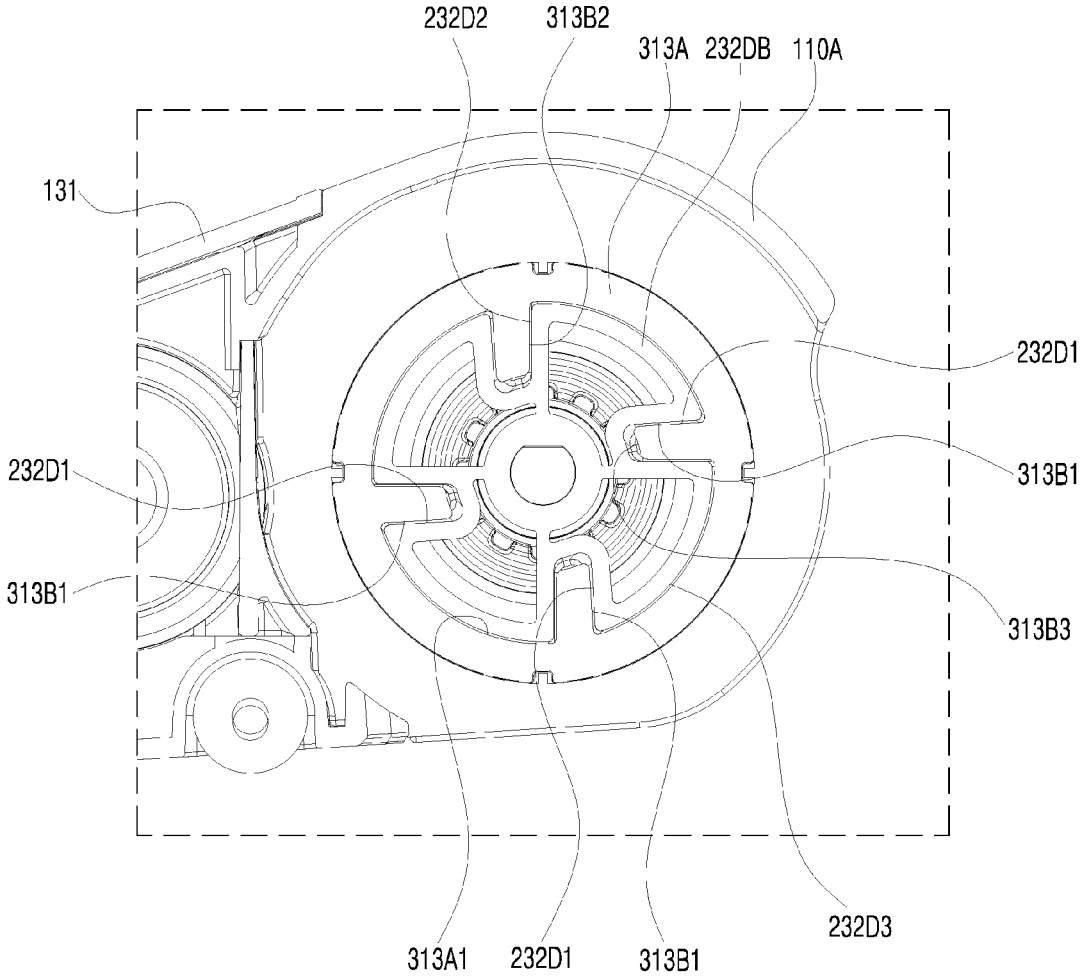
FIG. 35 is a cross-sectional view of the suction nozzle of FIG. 32 along the line from D to D'.

FIG. 32 is a cross-sectional view of the suction nozzle 10 of FIG. 19. FIG. 33 is a cross-sectional view of the suction nozzle 10 of FIG. 32 when the suction nozzle 10 is cut along the line from B to B'. FIG. 34 is a cross-sectional view of the suction nozzle 10 of FIG. 32 when the suction nozzle 10 is cut along the line from C to C'. FIG. 35 is a cross-sectional view of the suction nozzle 10 of FIG. 32 when the suction nozzle 10 is cut along the line from D to D'.

The second surfaces 313B1 may be surfaces receiving the rotational force of the first shaft member 232D. When the first shaft member 232D is inserted into the second shaft member 313, the second surfaces 313B1 and the first surfaces 232D1 may form first contact surfaces in a spiral shape along the axial direction. On the helical first contact surfaces, the rotational force of the first shaft member 232D may be transferred to the second shaft member 313.

The first contact surfaces may be axisymmetric with each other about the rotational axis of the rotating brush 310. The first contact surfaces may be positioned along the rotational direction of the first shaft member 232D towards the first axial direction.

Figure 36:
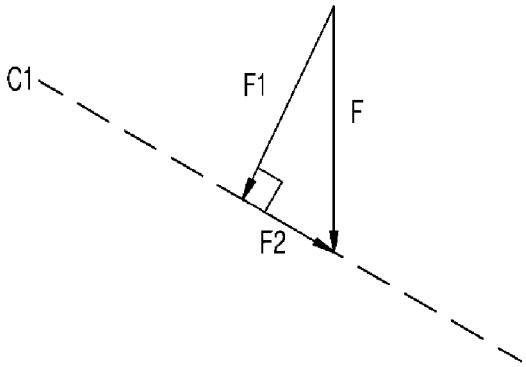
FIG. 36 is a view illustrating an example of force acting on a first contact surface.
Figure 37:
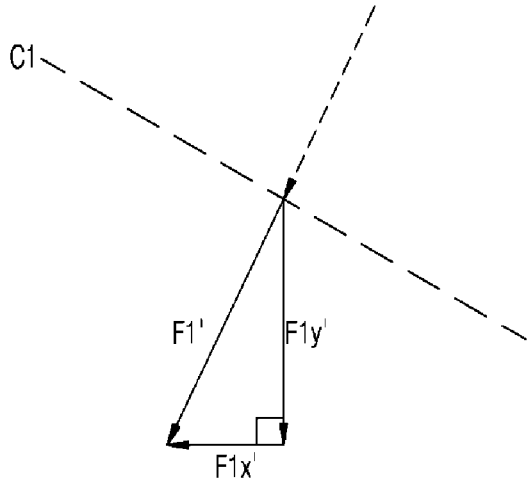
FIG. 37 is a view illustrating an example of force transferred to a second surface.

FIG. 36 illustrates an example of a force acting on a first contact surface (C1). FIG. 37 illustrates an example of a force acting on the second surface 313B1.

A rotational force (F) of the first shaft member 232D that is applied to the second surface 313B1 through the first contact surface (C1) may be divided into a force (F2; hereinafter referred to as a "friction component force") in parallel with the first contact surface (C1) and a force (F1; hereinafter referred to as an "action force") in the normal direction of the first contact surface (C1).

The first surface 232D1 and the second surface 313B1 may be smooth surfaces. That is, the frictional coefficient of the first contact surface (C1) may be relatively very small.

Accordingly, it may be assumed that the friction component force (F2) may be very small compared to the action force (F1). Accordingly, the first surfaces 232D1 and the second surfaces 313B1 may slip on the first contact surfaces (C1) due to the rotational force of the first shaft member 232D.

Thus, in general, the action force (F1) may act on the second surface 313B1 through the first contact surface (C1). An action force (F1') that is transferred to the second surface 313B1 through the first contact surface (C1) may be divided into an axial-directional component force (Flx'; hereinafter referred to as a "movement component force") and a component force in the same direction as the rotational force of the first shaft member 232D (Fly'; hereinafter referred to as a "rotation component force").

The rotating brush 310 may be rotated by the rotation component force (Fly'). Also, the rotating brush 310 may be pushed in the second axial direction by the movement component force (Flx'). The ratio of the movement component force (Flx') to the rotation component force (Fly') varies depending on a lead of the first contact surface (C1). The lead of the first contact surface (C1) may be equal to a lead of the first surface 232D1 and the second surface 313B1.

The vacuum cleaner of related art may have a deficiency in that when the vacuum cleaner is used, the rotating cleaning unit moves in the axial direction thereof due to the reaction force and the friction force of the floor. The axial-directional movement of the rotating cleaning unit may cause noise on contact surfaces between the rotating cleaning unit and the rotating support unit and among the first side surface cover and the second side surface cover and the chamber. In addition, the axial-directional movement of the rotating cleaning unit may cause damage to the coupling structure of the first side surface cover, the second side surface cover, and the chamber.

In some implementations, the vacuum cleaner 1 may have an advantage in that as the rotating brush 310 is continuously pushed in the second axial direction by the movement component force (Flx'), axial-directional movement of the rotating brush 310 may be restricted even when the reaction force and the friction force of the floor are applied in the axial direction.

A surface area of the first surfaces 232D1 may increasingly decrease towards the second axial direction. Accordingly, a surface area of the first contact surface may increasingly decrease towards the second axial direction.

The first surfaces 232D1 and the second surfaces 313B1 may be positioned increasingly closer to the rotational axis of the rotating brush 310 towards the second axial direction. Accordingly, the first contact surfaces may be positioned increasingly closer to the rotational axis of the rotating brush 310 towards the second axial direction.

Thus, as a distance by which the rotating brush 310 is pushed in the second axial direction increases, the movement component force (Flx') that is transferred to the second surfaces 313B1 through the first contact surface (C1) may decrease. Accordingly, a phenomenon in which the rotating brush 310 is excessively pushed in the second axial direction by the movement component force (Flx') may be restricted.

Fourth surfaces 313B2 of the second transfer portions 313B may extend from a side surface of the shaft body 313A in an approximately radial direction of the pulley shaft (PA). The fourth surfaces 313B2 may form a relatively small angle with the radial direction of the pulley shaft (PA).

The fourth surfaces 313B2 may be axisymmetric with each other about the pulley shaft (PA). The fourth surfaces 313B2 may be positioned increasingly closer to the rotational axis of the rotating brush 310 towards the second axial direction.

The fourth surfaces 313B2 may form a plane aligned with the axial direction of the rotating brush 310. When the first shaft member 232D pushes the second shaft member 313 in the second axial direction on the first contact surfaces formed in the spiral shape, the first shaft member 232D and the second shaft member 313 may be spaced apart in the axial direction while maintaining the first contact surfaces.

The first surfaces 232D1 and the second surfaces 313B1 may be positioned along the rotational direction of the first shaft member 232D towards the first axial direction. That is, with a single first transfer portion 232DB as a center, the first surface 232D1 and the third surface 232D2 may get closer to each other towards the second axial direction.

In addition, with a single second transfer portion 313B as a center, the second surface 313B1 and the fourth surface 313B2 may get closer to each other towards the second axial direction.

Accordingly, when the first shaft member 232D pushes the second shaft member 313 in the second axial direction through the first contact surface, the third surface 232D2 and the fourth surface 313B2 may be spaced apart from each other. That is, when the first shaft member 232D pushes the second shaft member 313 in the second axial direction through the first contact surface, the fourth surfaces and the third surfaces may not come into contact with each other on the second contact surfaces.

The fourth surfaces 313B2 may be surfaces which transfer the rotational inertia of the rotating brush 310 to the first shaft member 232D. When the first shaft member 232D is inserted into the second shaft member 313, the fourth surfaces and the third surfaces 232D2 may form a plurality of second contact surfaces aligned with the axial direction. The second contact surfaces may be axisymmetric with each other about the rotational axis of the rotating brush 310.

Figure 38:
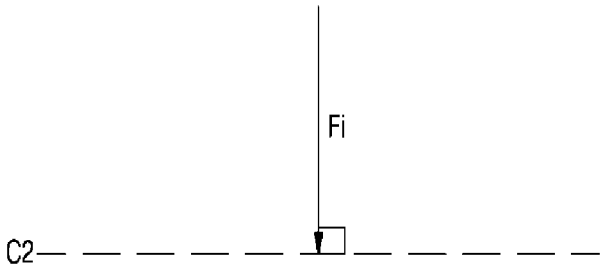
FIG. 38 is a view illustrating an example of force acting on a second contact surface.

FIG. 38 illustrates an example of a force acting on a second contact surface (C2).

After an operation of the driver 200 stops, the rotational inertia (Fi) of the rotating brush 310 may be transferred to the first shaft member 232D through the second contact surfaces (C2) until rotation of the rotating brush 310 stops. In some examples, while a rotational speed of the motor 220 decreases, the rotational inertia (Fi) of the rotating brush 310 may be transferred to the first shaft member 232D through the second contact surfaces C2.

The rotational inertia (Fi) of the rotating brush 310 may be transferred to the first shaft member 232D until the second shaft member 313 rotates at the same speed as that of the first shaft member 232D or stops. A rotational force of the second shaft member 313 that is applied to the third surface 232D2 through the second contact surface (C2) may act on the third surface 232D2 in a perpendicular direction.

Accordingly, until the second shaft member 313 rotates at the same speed as that of the first shaft member 232D or stops, the first shaft member 232D and the second shaft member 313 may stably maintain contact on the second contact surface.

Thus, relative movement of the first shaft member 232D and the second shaft member 313, which is caused by an external force transferred in the radial direction of the pulley shaft (PA) in the process in which the rotational speed of the motor 220 decreases, may be minimized.

When the first shaft member 232D is inserted into the second shaft member 313, the sixth surface 313A1 and the fifth surfaces 232D3 may form a contact surface. The sixth surface 313A1 and the fifth surface 232D3 may act as a boundary surface for blocking relative movement of the first shaft member 232D and the second shaft member 313 caused by an external force transferred in the radial direction of the pulley shaft (PA).

The seventh surface 313B3 may be a surface connecting the second surface 313B1 and the fourth surface 313B2. The seventh surface 313B3 may connect the second surface 313B1 and the fourth surface 313B2 in a circumferential direction of the pulley shaft (PA). Seventh surfaces 313B3 of the second transfer portions 313B may be axisymmetric with each other about the pulley shaft (PA).

The seventh surfaces 313B3 may be positioned increasingly closer to the rotational axis of the rotating brush 310 towards the second axial direction. When all the contact surfaces between the first shaft member 232D and the second shaft member 313 come into close contact with each other, the first shaft member 232D may be inserted into the second shaft member 313. With the first shaft member 232D being inserted into the second shaft member 313, the seventh surfaces 313B3 may be spaced apart from the hub 232DA.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this invention provided they come within the scope of the appended claims and their equivalents.

In some implementations, as the insertion portion is inserted into the inlet of the housing with the coupling part being mounted on the outer surface of the insertion portion, the inlet of the housing may restrict or reduce relative deformation of the insertion portion and the coupling part, and thus the state in which the coupling part is mounted on the outer surface of the insertion portion may be maintained. In some examples, decoupling between the housing and the connector, caused by an external force, may be avoided.

What is claimed is:

1. A vacuum cleaner comprising:

a main body that accommodates a motor, the motor being configured to generate a differential air pressure with respect to an outside of the vacuum cleaner; and a suction nozzle configured to suction dust from the outside based on the differential air pressure, the suction nozzle comprising:

a connector that defines a passage configured to guide the dust in a first direction to the main body, and a housing configured to rotatably connect to the connector, the housing defining an inlet that has a cylindrical shape and is configured to transfer the dust to the passage, wherein the connector comprises:

a first connection portion spaced apart from the inlet in the first direction, an insertion portion that protrudes from the first connection portion toward the inlet and is configured to insert into the inlet, the insertion portion having a cylindrical shape, and a coupling part disposed at an outer surface of the insertion portion, the coupling part and the first connection portion being configured to restrict movement of the housing in the first direction, wherein the coupling part comprises a pipe portion that has a cylindrical shape and is configured to insert into the inlet such that an inner surface of the inlet surrounds an outer surface of the pipe portion, wherein an inner surface of the pipe portion surrounds the outer surface of the insertion portion, and wherein the inlet is disposed outside the insertion portion and the pipe portion and configured to restrict deformation of the insertion portion and the pipe portion.

2. The vacuum cleaner of claim 1, wherein the pipe portion is disposed radially between the outer surface of the insertion portion and the inner surface of the inlet.

3. The vacuum cleaner of claim 1, wherein the connector comprises:

a second connection portion rotatably connected to the first connection portion; and an elastic pipe that defines at least a portion of the passage and is disposed between the inlet and the second connection portion.

4. The vacuum cleaner of claim 3, wherein the elastic pipe comprises:

an elastic tube that extends between the inlet and the second connection portion; and a coil spring attached to the elastic tube and configured to be compressed and extended in a range between the inlet and the second connection portion.

5. The vacuum cleaner of claim 1, wherein one of the insertion portion or the coupling part defines a catch hole, and wherein the other of the insertion portion or the coupling part comprises a catch portion configured to insert into the catch hole.

6. The vacuum cleaner of claim 5, wherein the pipe portion defines one of the catch portion or the catch hole, and wherein the coupling part further comprises a protrusion portion that protrudes from the outer surface of the pipe portion and extends along a circumferential direction of the pipe portion.

7. The vacuum cleaner of claim 6, wherein the coupling part comprises a spacing protrusion portion that protrudes from the outer surface of the pipe portion and extends along the circumferential direction of the pipe portion.

8. The vacuum cleaner of claim 6, wherein the protrusion portion defines a first boundary surface, wherein the first connection portion defines a second boundary surface, the second boundary surface being configured to face the first boundary surface and be spaced apart from the first boundary surface in the first direction, and wherein the housing comprises an interposition portion configured to be disposed between the first boundary surface and the second boundary surface.

9. The vacuum cleaner of claim 8, wherein the protrusion portion defines a third boundary surface, and wherein the interposition portion defines a fourth boundary surface configured to face the third boundary surface in a radial direction of the pipe portion.

10. The vacuum cleaner of claim 9, further comprising a rotating brush disposed in the housing, the housing comprising:

a main housing that defines the inlet and is configured to accommodate the rotating brush; and a mounting housing coupled to the main housing, wherein the interposition portion is disposed at the mounting housing.

11. The vacuum cleaner of claim 10, wherein the mounting housing comprises a mounting portion configured to surround the protrusion portion of the coupling part, the protrusion portion defining a fifth boundary surface, and wherein the mounting portion defines a sixth boundary surface configured to face the fifth boundary surface in the radial direction of the pipe portion.

12. A vacuum cleaner comprising:

a main body that accommodates a motor, the motor being configured to generate a differential air pressure with respect to an outside of the vacuum cleaner; and a suction nozzle configured to suction dust from the outside based on the differential air pressure, the suction nozzle comprising:

a connector that defines a passage configured to guide the dust in a first direction to the main body, and a housing that defines an inlet having a cylindrical shape and being configured to transfer the dust to the passage, wherein the connector comprises:

a pipe portion that has a cylindrical shape and is configured to insert into the inlet such that an inner surface of the inlet surrounds an outer surface of the pipe portion, a protrusion portion that protrudes from the outer surface of the pipe portion and defines a first boundary surface, a first connection portion spaced apart from the inlet in the first direction, the first connection portion defining a second boundary surface configured to face the first boundary surface in the first direction, and an insertion portion that protrudes from the first connection portion toward the inlet and is configured to insert into the inlet, the insertion portion having a cylindrical shape that has an outer surface configured to face an inner surface of the pipe portion such that the inner surface of the pipe portion surrounds the outer surface of the insertion portion, wherein the housing comprises an interposition portion configured to be disposed between the first boundary surface and the second boundary surface, and wherein the inlet is disposed outside the insertion portion and the pipe portion and configured to restrict deformation of the insertion portion and the pipe portion.

13. The vacuum cleaner of claim 12, further comprising a rotating brush disposed in the housing, the housing comprising:

a main housing that defines the inlet and is configured to accommodate the rotating brush; and a mounting housing coupled to the main housing.

14. The vacuum cleaner of claim 13, wherein the mounting housing comprises:

a cover portion that extends along an axial direction of the rotating brush and covers an upper surface of the main housing; and a mounting portion that surrounds the protrusion portion of the connector.

15. The vacuum cleaner of claim 14, wherein the mounting portion defines an aperture that receives the pipe portion and the insertion portion, and wherein the first connection portion is disposed outside of the mounting portion.

16. The vacuum cleaner of claim 15, wherein the pipe portion and the protrusion portion are disposed in the aperture and configured to couple to the insertion portion.

17. The vacuum cleaner of claim 15, wherein the pipe portion comprises a catch portion that protrudes from the outer surface of the pipe portion in a radial direction of the pipe portion, and wherein the insertion portion defines a catch hole configured to couple to the catch portion.

18. The vacuum cleaner of claim 15, wherein the insertion portion comprises a catch portion that protrudes from the outer surface of the insertion portion in a radial direction of the insertion portion, and wherein the pipe portion defines a catch hole configured to couple to the catch portion.

19. The vacuum cleaner of claim 15, wherein the connector comprises:

a second connection portion disposed rearward relative to the first connection portion and rotatably connected to the first connection portion; and an elastic pipe that defines at least a portion of the passage, the elastic pipe having a first portion connected to the inlet and a second portion connected to the second connection portion.

20. The vacuum cleaner of claim 19, wherein the housing is configured to cover the pipe portion, the insertion portion, and the first portion of the elastic pipe.

21. The vacuum cleaner of claim 19, wherein the first connection portion and the second connection portion define an opening that exposes at least a portion of the elastic pipe.

* * * * *